United States Patent [19]

Matsuda et al.

[11] Patent Number: 5,022,826

[45] Date of Patent: Jun. 11, 1991

[54] VARIABLE CAPACITY TYPE SWASH PLATE COMPRESSOR

[75] Inventors: Mikio Matsuda; Mitsuo Inagaki; Ikuo Hayashi; Masahiro Goto, all of Okazaki; Akikazu Kojima, Gamagori; Toshiki Taya, Nagoya; Nobuhiro Miura, Okazaki, all of Japan

[73] Assignees: Nippondenso Co., Ltd., Kariya; Nippon Soken, Inc., Nishio, both of Japan

[21] Appl. No.: 356,304

[22] Filed: May 24, 1989

[30] Foreign Application Priority Data

May 25, 1988 [JP] Japan ..... 63-126015

[51] Int. Cl.[5] ..... F04B 21/04; F04B 1/26; F04B 27/08

[52] U.S. Cl. ..... 417/63; 417/222 R; 417/270

[58] Field of Search ..... 417/63, 222, 270; 91/505, 506

[56] References Cited

U.S. PATENT DOCUMENTS 4,355,959 10/1982 Kono et al. .
4,462,491 7/1984 Kono et al. .
4,737,079 4/1988 Kurosawa et al. .
4,815,358 3/1989 Smith ..... 417/222 S
4,822,252 4/1989 Ishikawa et al. ..... 417/269
4,886,423 12/1989 Iwanami et al. ..... 417/222

FOREIGN PATENT DOCUMENTS 0259760 3/1988 European Pat. Off. .
56-64185 6/1981 Japan .
62-218670 9/1987 Japan .
63-154869 6/1988 Japan .
63-202778 12/1988 Japan .

*Primary Examiner*—Leonard E. Smith
*Assistant Examiner*—John A. Savio, III
*Attorney, Agent, or Firm*—Cushman, Darby & Cushman

[57] ABSTRACT

A variable capacity type swash plate compressor has a shaft, a swash plate, pistons functionally connected with the swash plate, and a detector for detecting the reciprocating stroke of the piston. The reciprocating stroke of the piston is varied in accordance with an inclining angle of the swash plate in such a manner that a top dead point of the piston at a working chamber defined at one end of the piston is substantially constant. The detector detects the change of the width of the reciprocating stroke of the piston and calculating the capacity of the compressor. The detector employs a plurality of magnets provided on a center portion of the piston and an electromagnetic sensor provided on a cylinder block for facing to the magnets.

13 Claims, 32 Drawing Sheets

$t_1/t_0 = \theta_1/2\pi$

| | comp. capacity(%) | |
|---|---|---|
| | 10～ 50 | 50～ 100 |
| OUT | 1 | 0 |

| | comp capacity (%) | | |
|---|---|---|---|
| | 10～30 | 30～70 | 70～100 |
| OUT 1 | 1 | 0 | 0 |
| OUT 2 | 1 | 1 | 0 |

| capacity | pulses/rotation |
|---|---|
| MIN | 2 |
| 1st | 3 |
| 2nd | 4 |
| MAX | 5 |

FIG. 45
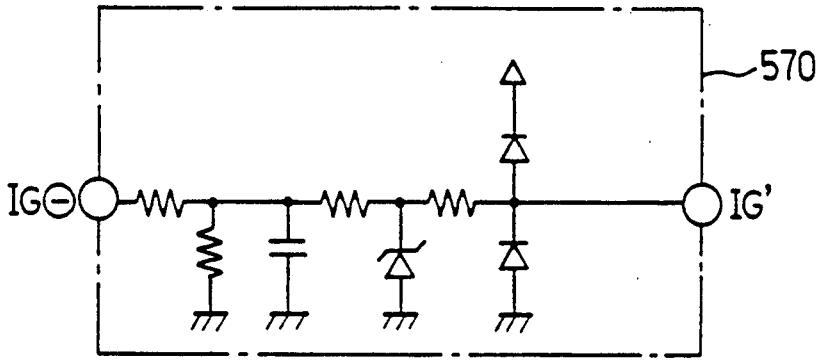
FIG. 46
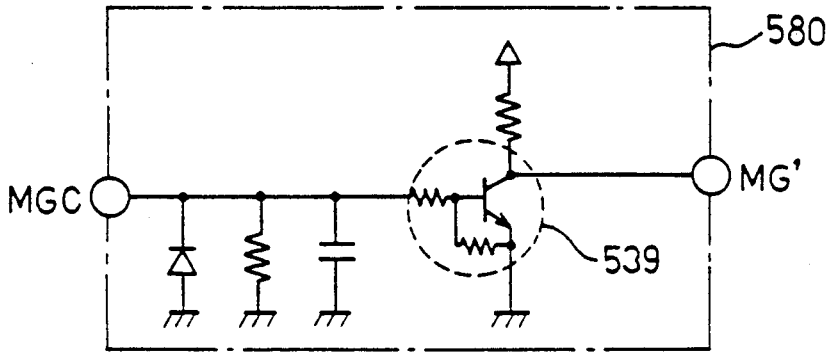
FIG. 47
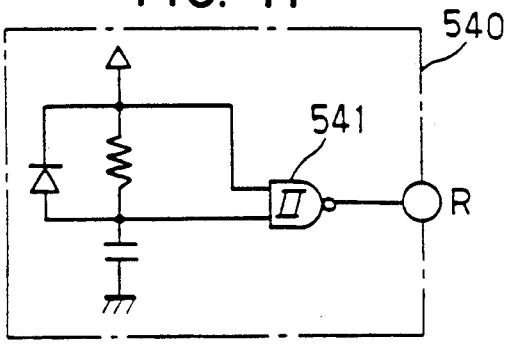
FIG. 48
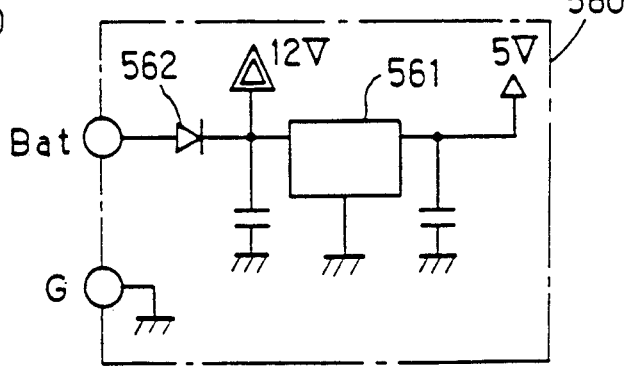
FIG. 50
| pulse MP' | O1 | O2 |
|---|---|---|
| 19 or less | 12V | 12V |
| 20~ 25 | 12V | OPEN |
| 26 or more | OPEN | OPEN |

VARIABLE CAPACITY TYPE SWASH PLATE COMPRESSOR

FIELD OF THE INVENTION

The present invention relates to a swash plate compressor which is useful as a refrigerant compressor for an automotive air conditioner, for example. The reciprocating stroke of a piston relating to the present compressor is continuously varied, so that the capacity of the compressor is variable.

BACKGROUND OF THE INVENTION

A compressor having a rotating shaft on which a swash plate is fixed and a piston functionally connected to the swash plate so that the piston reciprocates within a cylinder block has been known as a swash plate compressor. Such swash plate compressor has been used as a refrigerant compressor of an automotive air conditioner. The automotive refrigerant compressor is driven by an automotive engine through a belt which also drives a water pump and an generator. When the compressor causes some damages to the belt, the generator and the water pump cannot work. In order to protect such trouble, the compressor employs a rotation detector which finds whether the compressor rotates or not, and the detector outputs the signal for not transmitting the driving force from the belt to the compressor when the detector finds that the compressor cannot be rotated smoothly. The conventional type compressor employs a concave portion on an outer surface of a piston as a detective portion and an electromagnetic sensor as a detector provided on a cylinder block in such a manner that the electromagnetic sensor faces to the concave portion at least once while the piston reciprocates. The electromagnetic sensor generates a pulse in accordance with the movement of the concave portion so that the rotating detector finds the condition of the compressor having a trouble when the electromagnetic sensor detects no pulse.

The concave portion is formed on a skirt portion of the piston. Therefore, the length of the skirt portion must be shortened in order to form the concave portion therein, so that a sealing effect of the skirt portion should be decreased. The electromagnetic sensor of the conventional type detector should be mounted on the cylinder block close to the skirt portion of the piston Since the atmosphere around the skirt portion of the piston is high temperature, the electromagnetic sensor may be caused a kind of a thermal damage.

SUMMARY OF THE INVENTION

An object of the present invention is to provide a swash plate compressor having an enough sealing efficiency even though the rotation detector is equipped. Another object of the present invention is to provide swash plate compressor employing a rotation detector which is well protected from thermal damage Further object of the present invention is to provide a swash plate compressor employing a detector which can detect not only whether the compressor rotates or not but also the capacity of the compressor. Still another object of the present invention is to provide a variable capacity-type swash type compressor the capacity of which is varied in accordance with a reciprocating stroke of the piston, and the reciprocating stroke is detected by the detector.

A detected portion relating to the present invention is provided at a center portion of the piston and a detector relating to the present invention is mounted on a cylinder block apart from a piston head. The detective portion and the detector of the present invention is provided in such a manner that the detector can detect a change of piston stroke. Accordingly, the skirt portion of the piston of the present invention employs no concave portion so that the skirt portion has enough sealing length for sealing the gas compressed within the cylinder. Since the detector is provided apart from the skirt portion of the piston, the detector is well insulated from a heat generated around the skirt portion. The detector of the present invention outputs a signal to an automotive idling speed controller, for example, in such a manner that the idling speed of the automotive engine is increased when the detector detects high capacity of the compressor and the idling speed of the automotive engine is not so increased when the detector detects low capacity of the compressor.

BRIEF DESCRIPTION OF THE DRAWINGS

FIG. 43 indicates a number of an output pulse relating to a discharge capacity of a compressor.

FIGS. 44, 45, 46, 47, 48 and 49 show electric circuits, each of which is a part of a controlling circuit shown in FIG. 34.

FIG. 50 indicates an output signal relating to a number of a pulse of signal MP'.

DETAILED DESCRIPTION OF THE PREFERRED EMBODIMENTS

Figure 1:
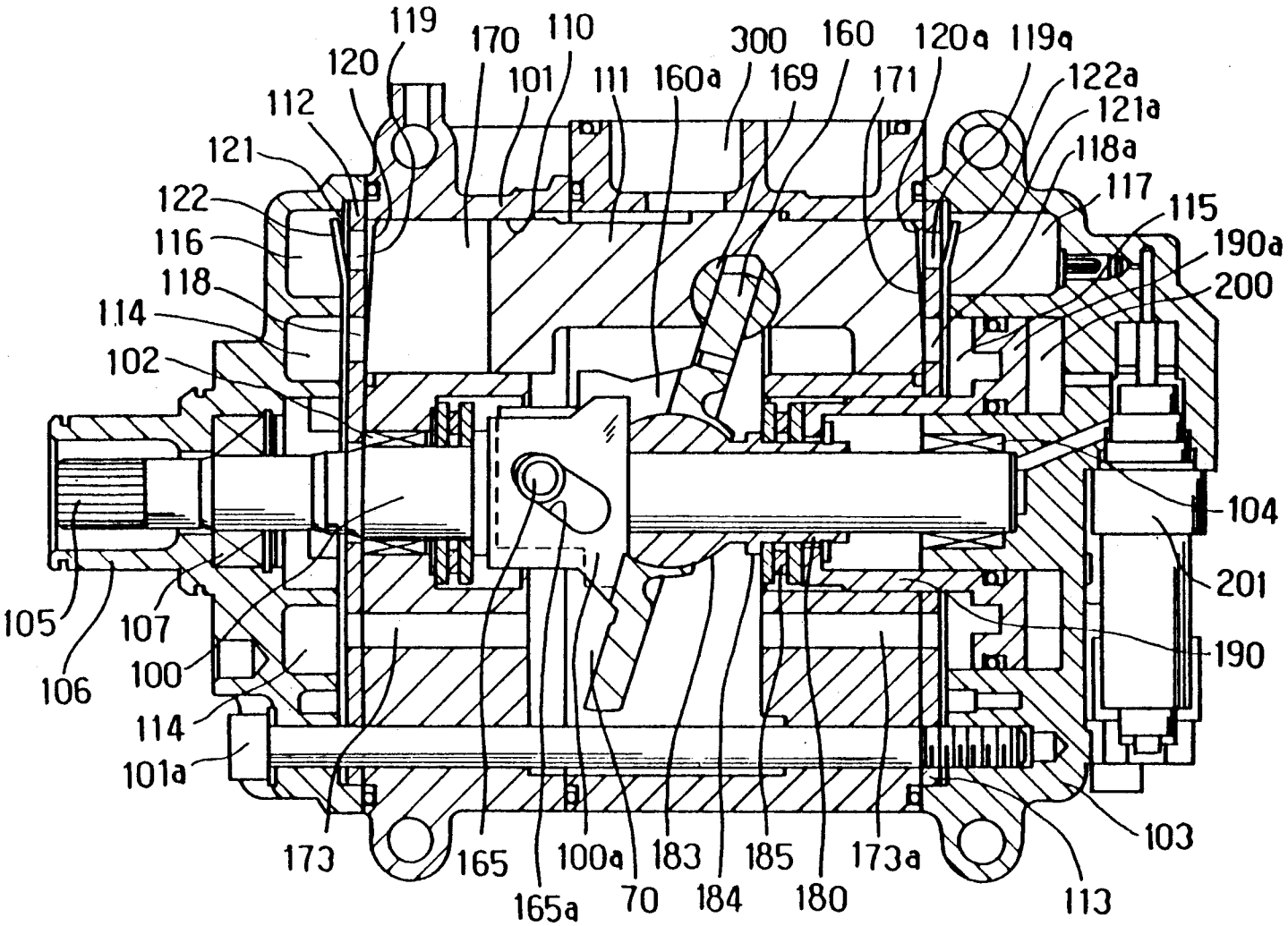
FIG. 1 is a sectional view of a variable capacity type swash plate compressor relating to the present invention, the compressor shown in FIG. 1 is its high capacity condition.
Figure 2:
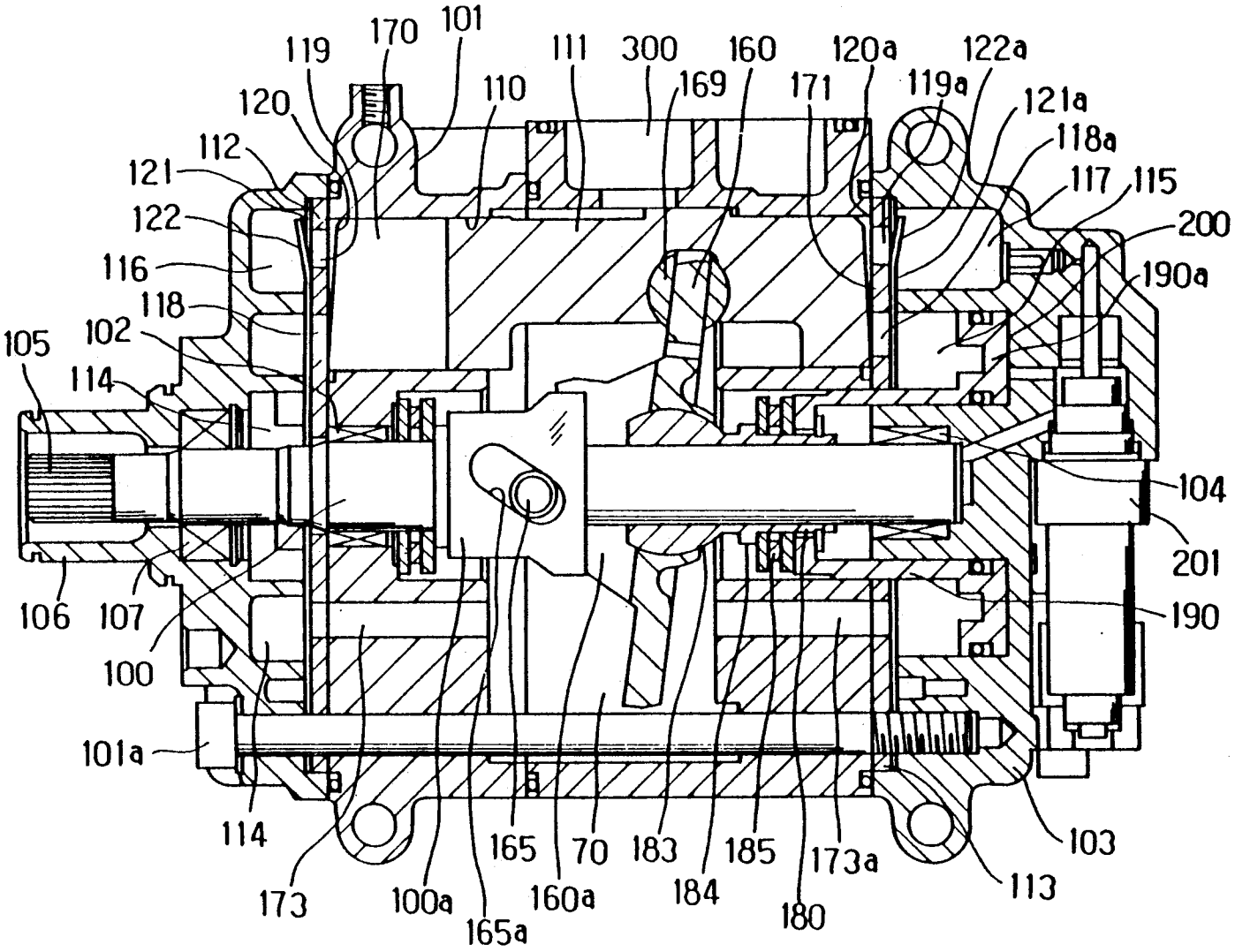
FIG. 2 is a sectional view of a compressor shown in FIG. 1, the compressor shown in FIG. 2 is its low capacity condition.

Five cylinder bores 110(only one of which is shown in FIGS. 1 and 2), are provided within a cylinder block 101, and a center chamber 70 is formed within the cylinder block 101. The cylinder block 101 further includes a suction path 300 through which a refrigerant introduced from an evaporator (not shown) flows toward the center chamber 70. The compressor is connected to the evaporator through a conduit (not shown) and a suction service valve (not shown). A front housing 106 and a rear housing 103 are provided at both sides of the cylinder block 101 via side plates 112 and 113, and the front housing 106, the side plate 112, the cylinder block 101, the side plate 113 and the rear housing 103 are fixed by bolts 101*a*. A shaft 100 is rotatably supported by a first bearing 102 which is mounted on a cylinder block 101 and a second bearing 104 which is mounted on the rear housing 103. One end 105 of the shaft 100 is protruded from the front housing 106 in such a manner that a sealing member 107 can seal between the shaft 100 and the front housing 106. Since the one end 105 is connected to an electromagnetic crutch (not shown), the rotating force of an automotive engine is transmitted to the shaft 100 through a belt and the electromagnetic crutch.

A piston 111 is slidably provided within the cylinder bore 110 so that a first working chamber 170 and a second working chamber 171 are provided within the cylinder bore 110 at both front ends of the piston 111. The piston 111 is so functionally connected to a swash plate 160 that wobbling movement of the swash plate 160 is transferred to the reciprocating movement of the piston 111. The swash plate 160 has a protruding portion 160*a* including a pin portion 165. The protruding portion 160*a* is connected to a connecting member 100*a* which is provided on the shaft 100, and the protruding portion 160*a* can slide between a first position which is shown in FIG. 1 and a second position which is shown in FIG. 2. The pin portion 165 slides within a slit 165*a* formed in the connecting member 100*a* while the portion 160*a* moves, so that the inclining angle of the swash plate 160 varies from a first position which is shown in FIG. 1 to a second position which is shown in FIG. 2. The rotating center of the swash plate 160, namely the point of the spherical supporting portion 183, is also varied in accordance with an increment of the swash plate, so that the top dead point of the piston 111 at the second working chamber 171 does not substantially change even though the reciprocating stroke of the piston is varied. Accordingly, no substantial dead volume is formed at the second working chamber 171. The top dead point of the piston 111 of the first working chamber 170, on the other hand, is varied in accordance with the increment of the swash plate 160, so that the dead volume in the first working chamber 170 is increased in accordance with the increment of the swash plate.

The slit 165*a* must be curved in order to keep the top dead point of the piston 111 at the second working chamber 171 absolutely same position. The straight slit 165*a* can also be used practically. The slit 165*a* is formed on an axis of the shaft 100 in order to reduce the volume of the connecting member 100*a*. The protruding portion 160*a* and the connecting member 100*a* are so connected that the swash plate 160 rotates synchronizedly with the shaft 100 and that the increment of the swash plate can be varied.

A couple of shoes 169 are provided between the swash plate 160 and the piston 111 in order to transfer the wobbling movement of the swash plate 160 to the reciprocating movement of the piston 111.

A suction chamber 114 and a discharge chamber 116 are formed within the front housing 106, and the sealing member 107 is provided within the suction chamber 114. The sealing member 107 prevents the leakage of the refrigerant and the lubricant. The suction chamber 114 is connected to the center chamber 70 through a hole formed in the side plate 112 and a first passage 173 formed in the cylinder block 101. The suction chamber 114 also connected to the first working chamber 170 through a suction port 118 formed in the side plate 112. The discharge chamber 116 is connected to the first working chamber 170 through a discharge port 119 formed in the side plate 112. A sheet type suction valve 120 is provided at a first working chamber 170 side of the side plate 112 in such a manner that the suction valve 120 opens the suction port 119 when the piston 112 slides rightwardly in FIG. 1. A sheet type discharge valve 121 is also provided at the discharge chamber 116 side of the side plate 112 in such a manner that the discharge valve 121 opens the discharge port when the piston 111 moves leftwardly in FIG. 1. The discharge valve 121 is covered by a valve cover 122.

A suction chamber 115 and a discharge chamber 117 are formed in the rear housing 103 . The suction chamber 115 is connected to the center chamber 70 through a hole formed 15 in the side plate 113 and a path 173*a* formed in the cylinder block 111. The suction chamber 115 is also connected to the second working chamber 171 through a suction port 121*a* formed in the side plate 113, the discharge chamber 117 is connected to the second working chamber 171 through a discharge port 119*a* formed in the side plate 113. A suction valve 120*a*, a discharge valve 121*a* and a valve cover are provided on the side plate 113. A switching valve 201 and a controlling chamber 200 are provided within the rear housing 103.

A slider 180 is slidably mounted on the shaft 100, the slider 180 has a spherical supporting portion 183 and the slider 180 supports a rotating center of the swash plate 160 in such a manner that the swash plate 160 can rotate around the shaft 100 and the swash plate 160 can slide along with the axis of the shaft 100. The slider 180 has a flange portion 184 which is connected to the end portion of a spool 190 through a thrust bearing 185, so that the axial movement of the spool 190 is transmitted to the slider 180 through the thrust bearing 185.

The spool 190 also has a piston portion 190*a* by which the controlling chamber 200 is defined in the rear housing 103. The controlling pressure introduced into the controlling chamber 200 is switched between the suction pressure and the discharge pressure by the switching valve 201. Namely, the switching valve 201 switches between a first condition that the controlling chamber 200 is connected to the discharge chamber 117 and a second condition that the controlling chamber 200 is connected to the suction chamber 115.

Figure 3:
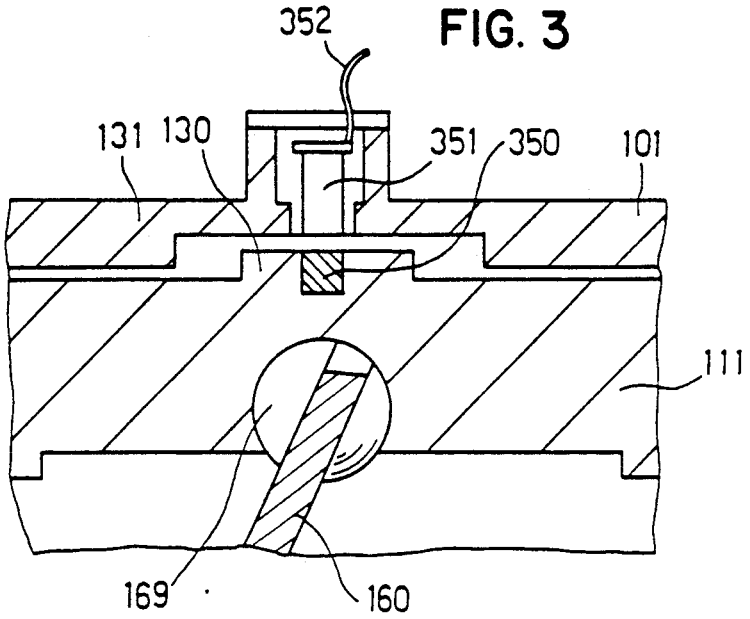
FIG. 3 is an enlarged view of a rotating detector.

A rotating detector of the present embodiment is explained hereinafter. As shown in FIG. 3 a magnetic member 350 which works as a detective portion is provided within a holding portion 130 formed at a center portion of the piston 111. The swiveling motion of the piston 111 is prevented by the holding portion 130. An electromagnetic sensor 351 which works as a detecting sensor is provided on a center wall 131 of the cylinder block 101. The center wall 131 defines the center chamber 70 therein. The magnetic member 350 faces to the electromagnetic sensor 351 keeping a slight gap therebetween. The electromagnetic sensor 351 has a magnet positioned at a center portion and a coil wound around the magnet. The coil is electrically connected with a controlling circuit through a leed wire 352. The rotating detector detects the change of the density of the magnetic density formed around the magnet of the electromagnetic sensor and generates an electric current in the coil of the electromagnetic sensor, so that the electromagnetic sensor outputs the electric signal which relates to the reciprocating movement of the magnetic member 350.

Figure 4:
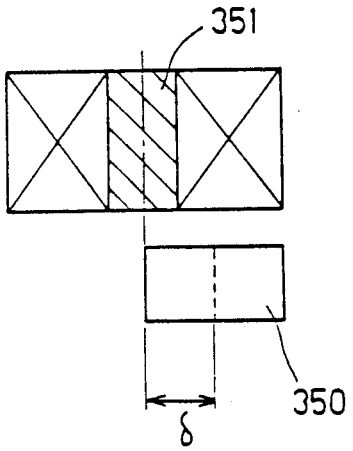
FIG. 4 shows a positional relation between a detective portion and an electromagnetic sensor.

The positional relation between the center portion of the electromagnetic sensor 351 and the center portion of the magnetic member 350 is explained hereinafter by referring the FIG. 4. FIG. 4 shows the condition that the piston 111 moves most leftwardly toward the first working chamber 170 while the reciprocating stroke of the piston 111 becomes minimize. As shown in FIG. 4, the electromagnetic sensor 351 and the magnetic member 350 are so positioned that one half of the width of the electromagnetic sensor 351 faces to the magnetic member 350. It is asserted by the present inventors that the magnetic sensor can detect the change of the density of the magnetic flux when one half of the width of the electromagnetic sensor faces to the magnetic member.

Since the top dead point of the piston 111 at the second working chamber 171 can be maintained even though the reciprocating stroke of the piston 111 is increased, the range at which the magnetic member 350 faces to the electromagnetic sensor 351 increases when the reciprocating stroke of the piston 111 is increased, so that the electromagnetic sensor can detect the change of the density of the magnetic flux.

The operation of the compressor according to the above described embodiment is explained hereinafter. The switching valve 201 connects the controlling chamber 200 to the discharge chamber 117 when the compressor is required the maximum capacity thereof. Since the pressure applied to the right side of the piston portion 190*a* of the spool 190 is greater than the pressure applied to the left side, the spool 190 is forced toward left side, so that the slider 180 and the rotating center of the swash plate 160 are also moved leftwardly until the left end of the slider 180 is abutted to the connecting member 100*a*, as shown in FIG. 1. The protruding portion 160*a* as well as the pin 165 is also moved leftwardly when the swash plate moves leftwardly, so that the pin 165 slides toward upper left end of the slit 165*a* of the connecting member 100*a*. The increment angle of the swash plate 160 increases in accordance with the movement of the pin 165.

Since the swash plate 160 is wobbled synchronizedly with the rotation of the shaft 100, and since the piston 111 is functionally connected with the swash plate 160 through a couple of shoes 169, the piston 111 reciprocates within the cylinder bore 110 when the shaft driven. The refrigerant is introduced into the first working chamber 170 and the second working chamber 171 compressed therein and discharged therefrom. The compressed refrigerant is discharged toward a condenser of a refrigerant circuit (not shown) from the discharge chambers 116 and 117.

The switching valve 201 connects the controlling chamber 200 to the suction chamber 115 when the compressor is required to reduce the capacity thereof. Since the pressure is different between both sides of the piston portion 190*a* of the spool 190, and since the swash plate 160 is received the compression force from the piston which works to reduce the inclining angle of the swash plate, the piston portion 190*a* is forced righwardly in FIG. 2. The compression force applied to the swash plate 160 from the piston 111 is controlled by the pin 165 and the slit 165*a* so that the compression force causes a divided force for forcing the rotating center portion of the swash plate 160 along with the axial line of the shaft 100. The divided force is transmitted to the spool 190 through the slider 180. FIG. 2 shows the condition that spool moves most rightwardly until the spool 190 abuts the controlling chamber 200 and the discharge capacity of the compressor becomes minimize.

Since the dead volume of the first working chamber 170 becomes large when the spool 190 moves rightwardly as shown in FIG. 2, the compression ratio within the first working chamber 170 is smaller than the compression ratio within the second working chamber 171, so that the pressure of the refrigerant compressed within the fist working chamber 170 becomes smaller than the pressure within the discharge chamber. The discharged pressure from the second working chamber 171 is introduced into the discharged chamber within the front housing. Accordingly, the first working chamber 170 can not discharge the refrigerant while the dead volume within the first working chamber becomes more than a predetermined value.

Figure 5:
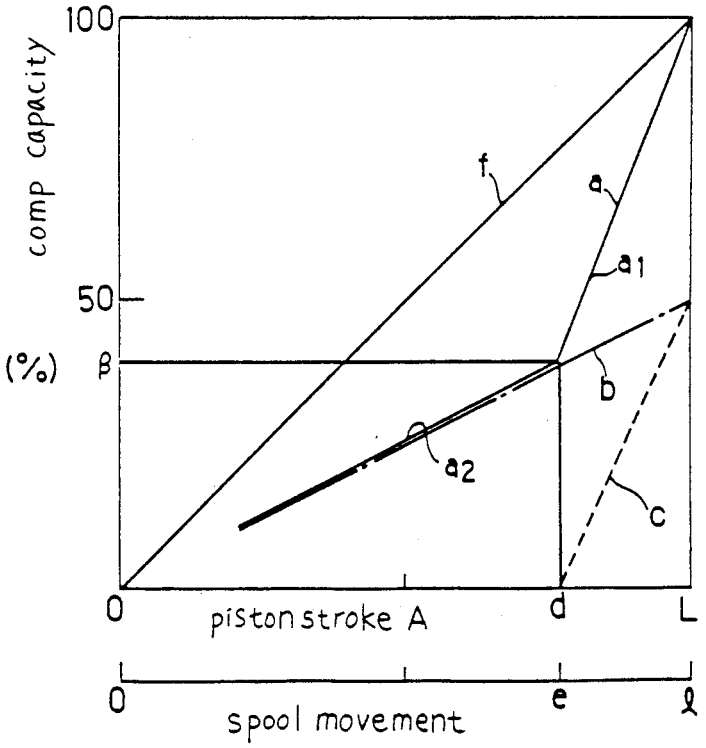
FIG. 5 shows a relationship between a movement of a spool and a discharge capacity of a compressor.

A solid line a within FIG. 5 shows the relationship between the piston stroke and the discharge capacity of the compressor. Since the reciprocating stroke of the piston 111 is varied in accordance with the movement of the rotating center of the swash plate 160, the dead volume formed within the second working chamber 171 does not substantially increase even though the reciprocating stroke of the piston 111 is varied, so that the discharge capacity of the second working chamber 171 is varied in accordance with the piston stroke (as shown by dotted line b in FIG. 5). The dead volume formed within the first working chamber 170 is, on the other hand, increased in accordance with the reduction of the piston stroke, so that the discharge capacity of the first working chamber is reduced sharply as shown by dotted line c in FIG. 5. The first working chamber 170 cannot work when the maximum pressure within the first working chamber 170 becomes smaller than the discharged pressure from the second working chamber (d point in FIG. 5). Namely, only the second working chamber 171 can work while the piston stroke is smaller than the point d. As described above, the discharge capacity of the compressor is varied in accordance with the movement of the spool, and the discharge capacitor is varied as shown by solid line $a_1$ in FIG. 5 while the movement amount of the spool 190 is within the range from 1 to e. The discharge capacity of the compressor is varied as shown by solid line a2 while the movement value of the spool 190 is within the range from e to o. Since the inclining angle of the solid line a2 is smaller than the line f which shows continuous variation, the discharge capacity of the present invention can be well controlled when the discharge capacity is smaller than the predetermined value w.

The operation of the detector of the present embodiment is described hereinafter. The detected portion 350 provided on the piston 111 passes through the electromagnetic sensor 351 twice while the piston 111 reciprocates. Since the density of the magnetic flux formed between the magnet provided at the center portion of the electromagnetic sensor 351 and the magnetic member 350 is changed when the magnetic member 350 faces to the magnet, an electric current is generated within the coil wound around the magnet. The electric current is amplified by the amplifier (not shown). Accordingly, the electromagnetic sensor 351 outputs the pulse which is synchronized with the rotating of the shaft. The electromagnetic sensor 351 does not output the pulse when the shaft 100 stops its rotation such as the condition that the piston 101 can not slide smoothly or the bearing can not support effectively. So that the extraordinary condition is detected when the electromagnetic sensor 351 does not output the pulse. The magnet crutch stops the transmission of the driving force from the belt to the shaft 100 when the electromagnetic sensor 351 detects such extraordinary condition for protecting the belt and the generator and the water valve driven by the belt.

Since the magnetic member 350 is provided at the holding portion 130 of the piston 111, the magnetic sensor 350 causes no influence to the skirt portion of the piston which seals the working chamber, so that the sealing efficiency of the working chamber is well maintained. Since the electromagnetic sensor 351 is provided on the center wall portion 131 which defines the center chamber 70, the electromagnetic sensor 351 is cooled by the low temperature refrigerant within the center chamber 70. Since the magnetic member 350 is provided on the center portion 130 which faces to the cylinder block by keeping a small gap therebetween, the air gap between the end portion of the electromagnetic sensor 351 and the magnetic 350 can be very small, so that the electromagnetic sensor 351 can well detect the change of the density of the magnetic flux. According1y, the electromagnetic sensor 351 can detect the rotating speed of the compressor even while the reciprocating speed of the piston is very slow.

Though the detector of the above described embodiments detects the rotating speed of the shaft 100, the detector can detect other than rotating speed. The detector 351 can detect the change of the reciprocating stroke of the piston 111 in order to calculate the discharge capacity of the compressor.

Figure 6:
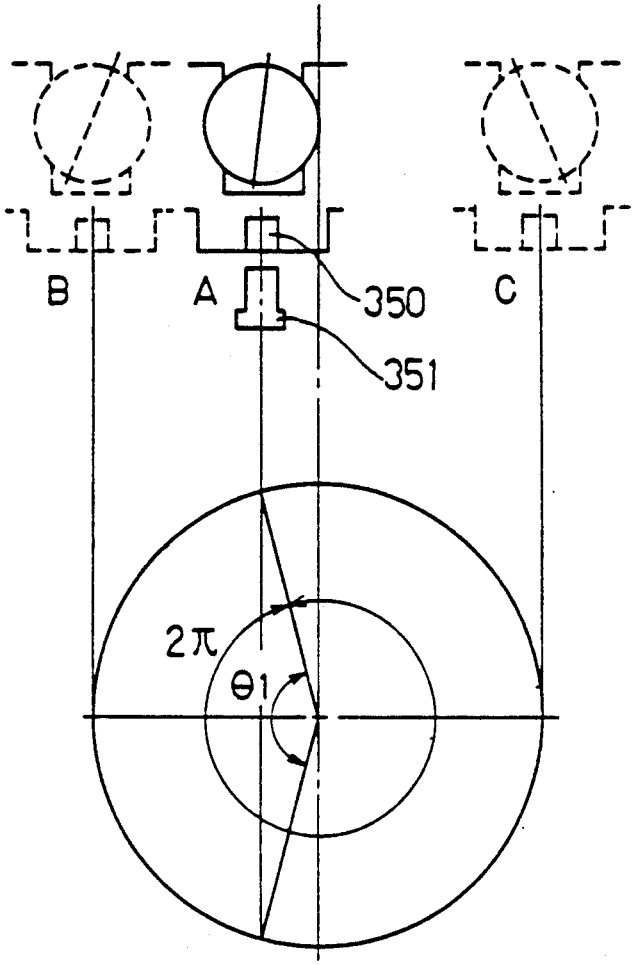
FIG. 6 shows a positional relation between a reciprocating stroke of a piston and an interval angle $\theta 1$ between timings when a magnet passes through a electromagnetic sensor.

The detector 350 detects the timing angle $\theta 1$ from the condition when the detected portion 350 passes through the detector(A point in FIG. 6) to the condition the detected portion passes through the detector 351(A point in FIG. 6) after the detected portion 351 moves most rightwardly toward the first working chamber 170 (B point in FIG. 6). The amount of the reciprocating stroke of the piston 111 is calculated by the proportion of the interval angle 1 and one stroke of the piston 111 ($2\pi$).

Figure 7:
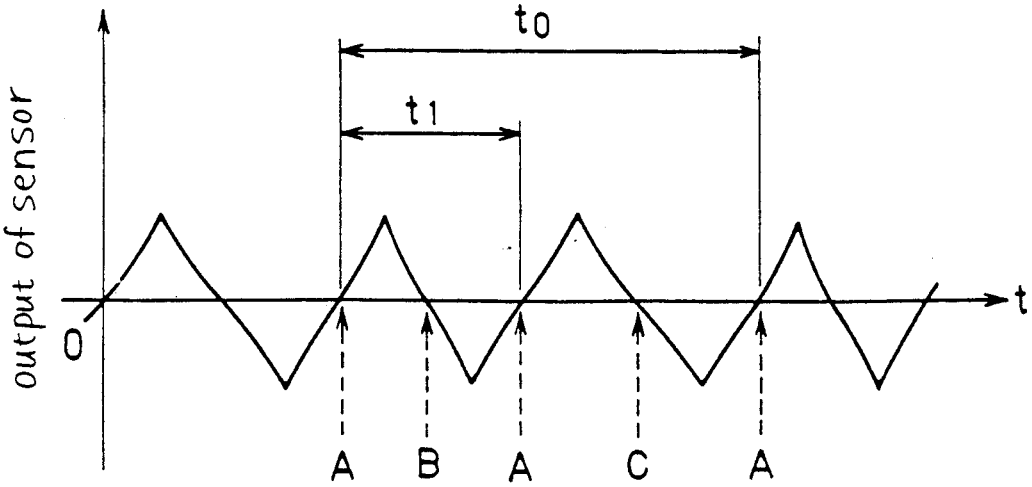
FIG. 7 shows an output signal of an electromagnetic sensor.
Figure 8:
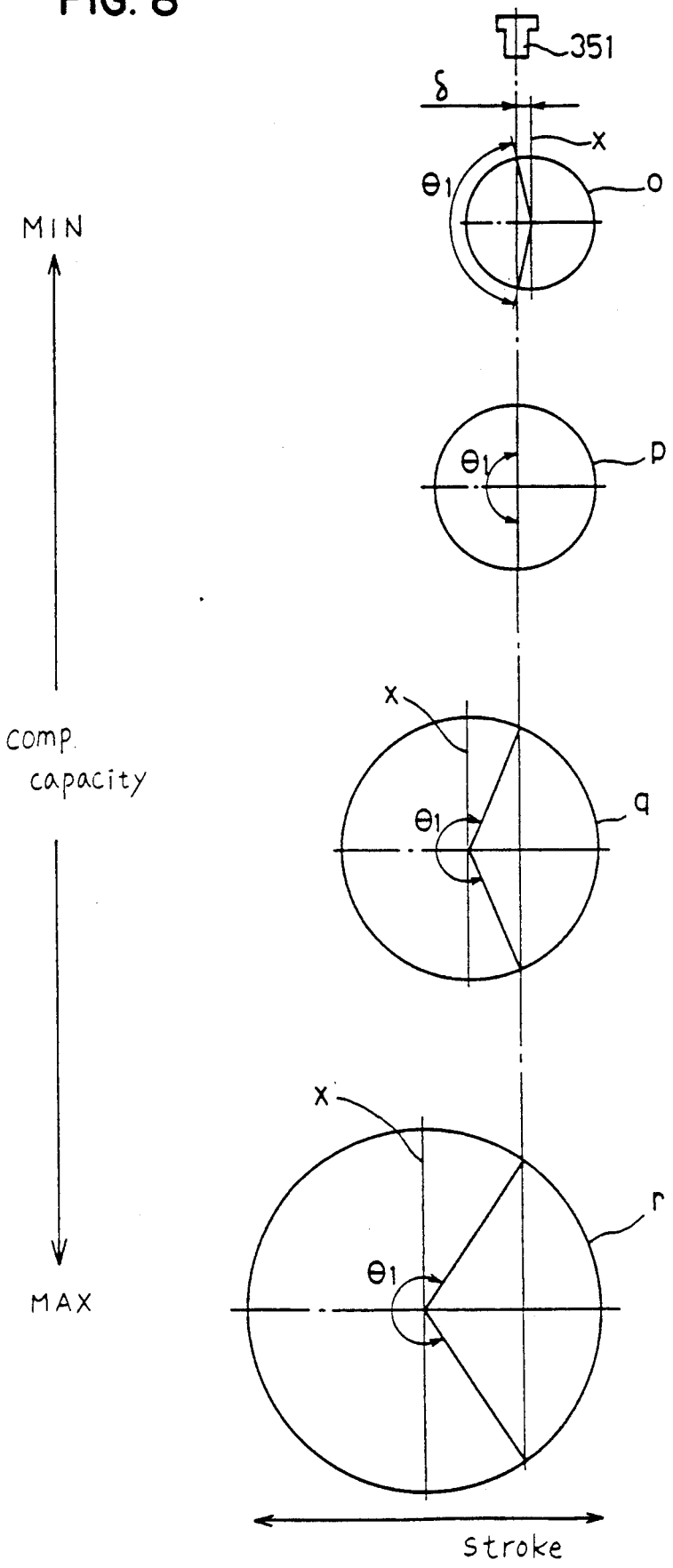
FIG. 8 shows a positional relation between reciprocating stroke which relates to a capacity of a compressor and an interval $\theta 1$.
Figure 9:
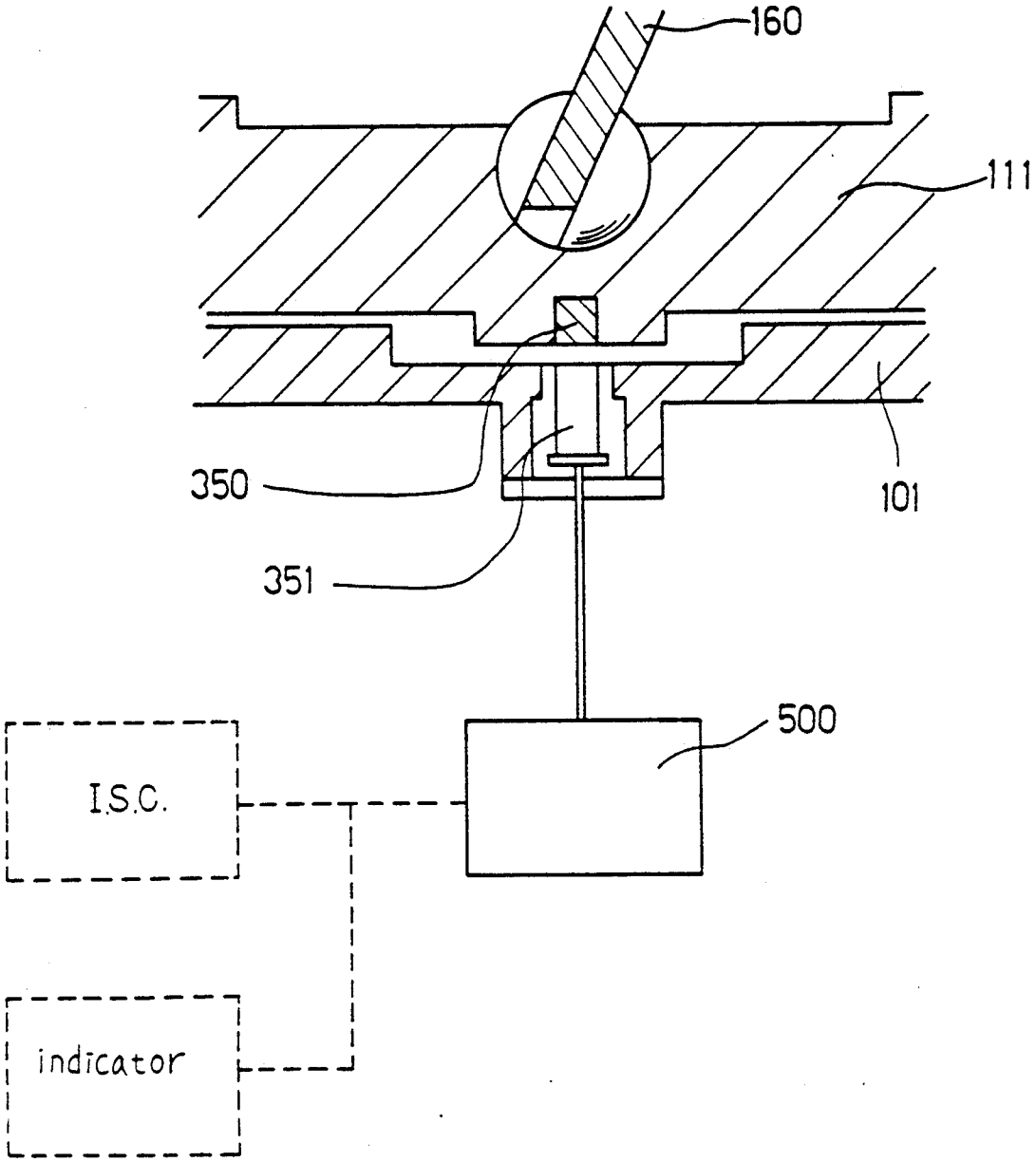
FIG. 9 is a sectional view showing a detector and a controlling circuit.

FIG. 7 shows the timing relation between the output of the detector 351 and the position of the piston 111. A. B, C points in FIG. 7 represent the conditions shown in A, B, C in FIG. 6 respectively. As shown from FIG. 7, the output signal from the detector 351 becomes maximum when the detective portion passes through the detector 351. The interval between the peak point (time T0) indicate one stroke ($2\pi$). The interval angle $\theta 1$ is calculated by using the time T1, and both intervals T0 and T1 are detected by the electromagnetic sensor 351. The calculation of the piston stroke is further explained hereinafter by referring FIG. 8. Circles o, p, q and r indicate the reciprocating circle of the detected portion 350. The circle o indicates the condition when the reciprocating stroke of the piston 111 becomes minimize, the circle r indicates the condition that the reciprocating stroke of the piston 111 becomes maximum. As clearly understood from the circles o, p, q and r in FIG. 8, the center position x of the reciprocating stroke of the detected portion 350 is moved toward the first working chamber 170 side as to the increment of the reciprocating stroke of the piston 111. The angle $\theta 1$ is less than 180° when the center portion x is positioned at the second working chamber 171 side of the detector 351 (shown as the circle o in FIG. 8), and the angle $\theta 1$ becomes 80° when the center position x is positioned on the same point of the detector 351 (shown as the circle p in FIG. 8). The angle $\theta 1$ becomes more than 180° when the center portion x is moved the first working chamber 170 side of the detector 351 (as shown by the circles p and r). Accordingly the angle $\theta 1$ is increased in accordance with the movement of the center portion x from the second working chamber 171 side to the first working chamber 170 side. Therefore, the reciprocating stroke of the piston 111 which indicates the discharge capacity of the compressor is calculated by the ratio of the angle $\theta 1$ and $2\pi$. FIG. 9 shows the embodiment employing the controlling circuit 500 the detail of which is explained later.

Figure 10:
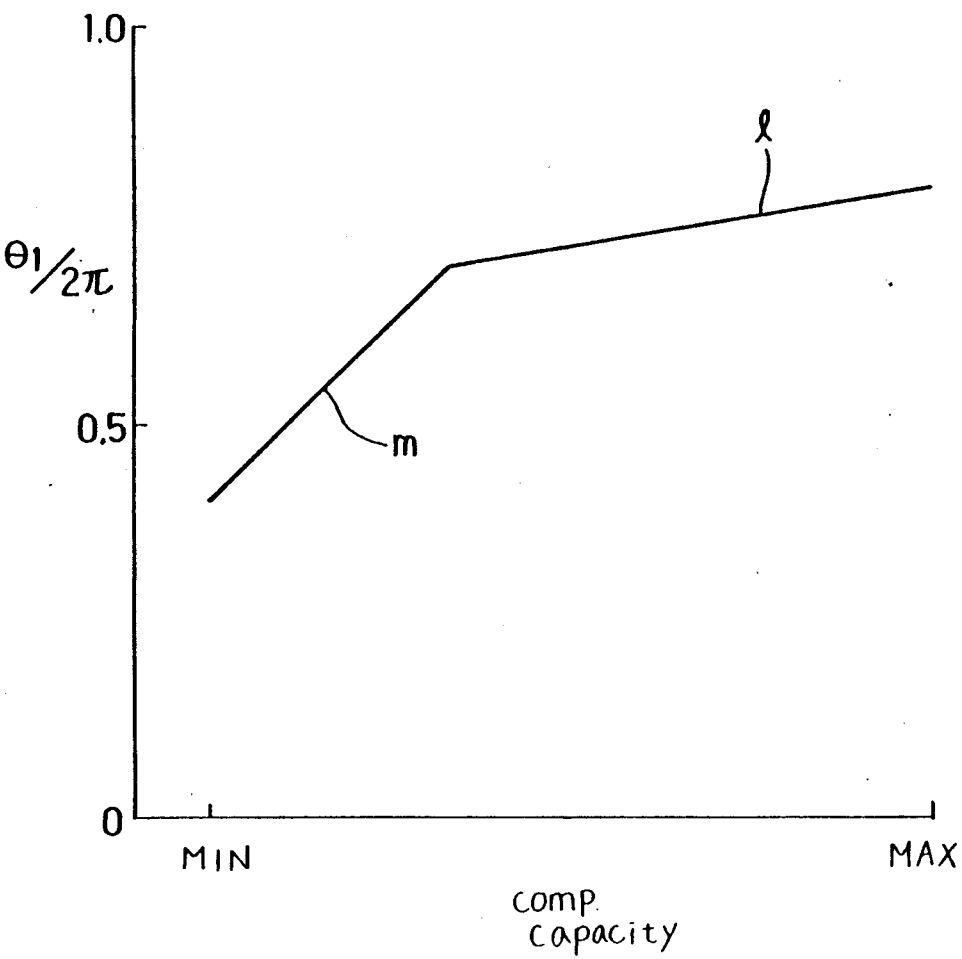
FIG. 10 shows a relationship between a discharge capacity of a compressor and an output signal of a detector.

As the discharge capacity of the compressor is varied in accordance with the piston stroke (shown in FIG. 5), and as the ratio of $\theta 1/2\pi$ indicates the piston stroke, the ratio of $\theta 1/2\pi$ indicates the discharge capacity of the compressor as shown in FIG. 10. The controlling circuit calculates the discharge capacity of the compressor by using the relationship shown in FIG. 10.

Figure 11:
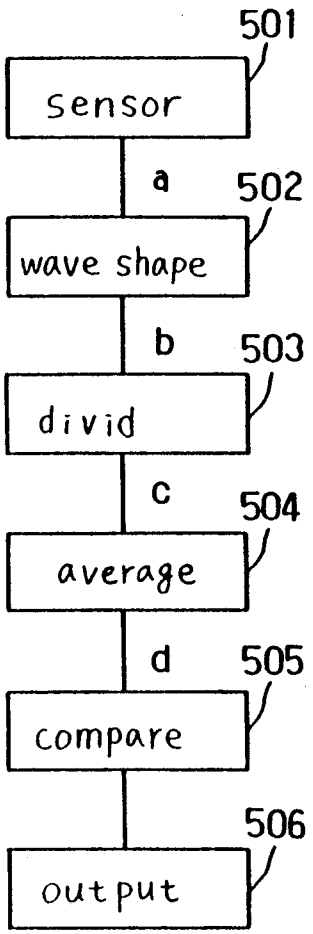
FIG. 11 is a flow-chart showing a sequence of a controlling circuit.

FIG. 11 shows the controlling flow of the controlling circuit 500. The output signal from the detector 351 is input to the circuit 500(step 501), and the output signal of the detector 351 is shaped (step 502) to be rectangular. The wave shaped output signal is divided in order to indicate the ratio of $\theta 1/2\pi$ (step 503). As described above, the ratio of $\theta 1/2\pi$ is obtained from the ratio of T1/T0. The output signal from the step 503 is processed in order to make the average level of the ratio (step 504). Since the average level generated by the step 504 is varied continuously, the average level indicates the reciprocating stroke of the piston 111 which shows the discharge capacity of the compressor. Step 505 in FIG. 11 is a comparing step for finding whether the average level from step 504 is greater than a predetermined value nor not. If comparing step 505 finds the average level is greater than the predetermined level, the controlling circuit 500 outputs a signal (Step 506) which indicates the condition that the discharger capacity of the compressor is more than 70%, for example, and causes the idling speed of the automotive engine is increased.

Figure 12:
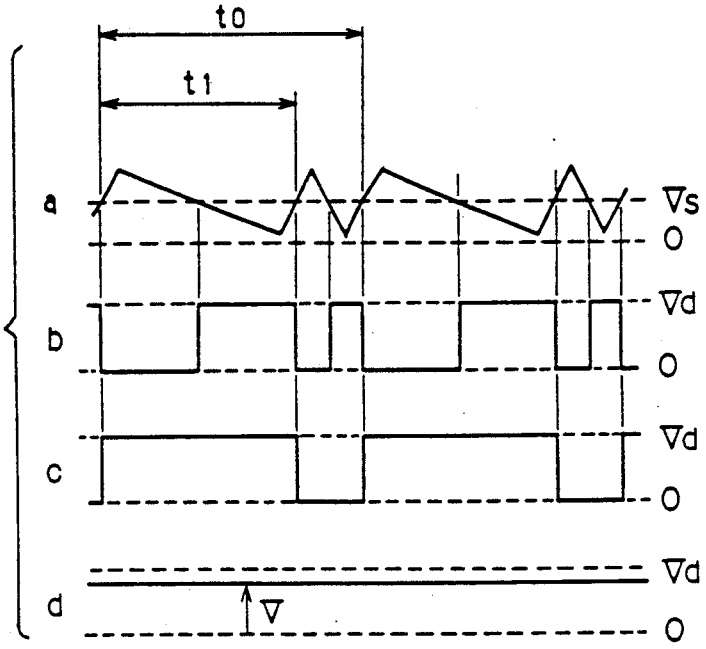
FIG. 12 shows output signals of each step of a controlling flow shown in FIG. 11.

FIG. 12 shows the output signals of each of the steps shown in FIG. 11. Namely, a indicates saw shaped signal output from the step 501, b indicates rectangular wave shaped signal shaped by the step 502, c indicates the signal divided by the step 503, and d indicates the signal processed by the step 504 the voltage of which continuously varied.

Figure 13A:
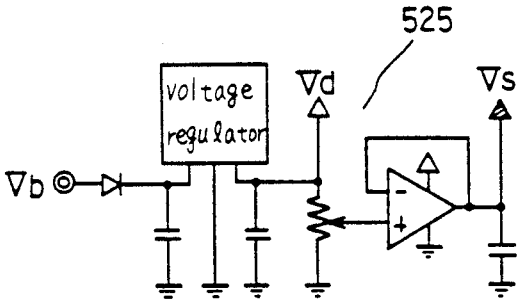
FIGS. 13*a* and *b* represent an electric circuit completing a control shown in FIG. 11.
Figure 13B:
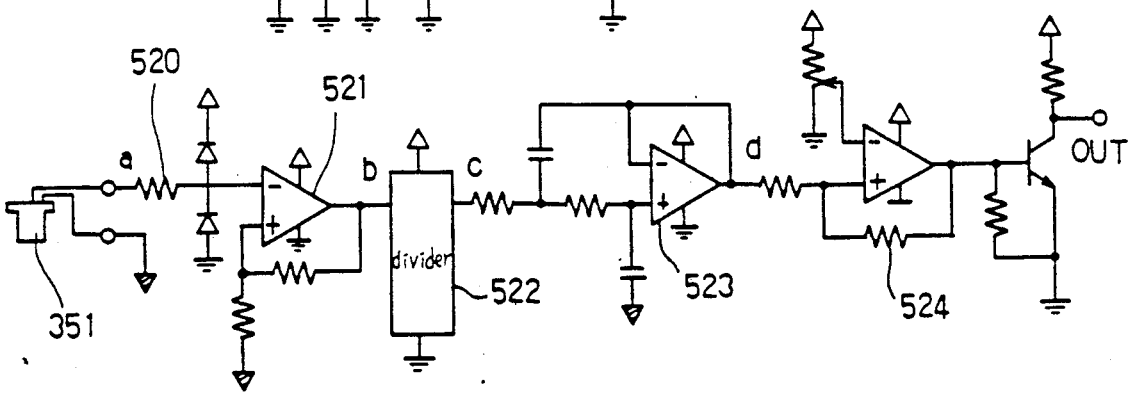

The electric circuit for the completing the sequence shown in FIG. 11 is described in FIG. 13. The signal output from the detector 351 is treated by a resister 520 in order to filter a small noise from the output signal a, and the signal a is shaped to be rectangular by a wave shaper 521. The signal b output from the wave shaper 521 is divided by a divider 522, and the signal c output from the divider 522 is then averaged by a circuit 523 so that the voltage level of the signal d output from the circuit 523 is continuously varied. The signal d output from the circuit 523 is compared with a set value by a comparing circuit 524. Numeral 525 indicates a voltage regulating circuit which supplies a constant output voltage VS(4V).

Figures 16, 17:
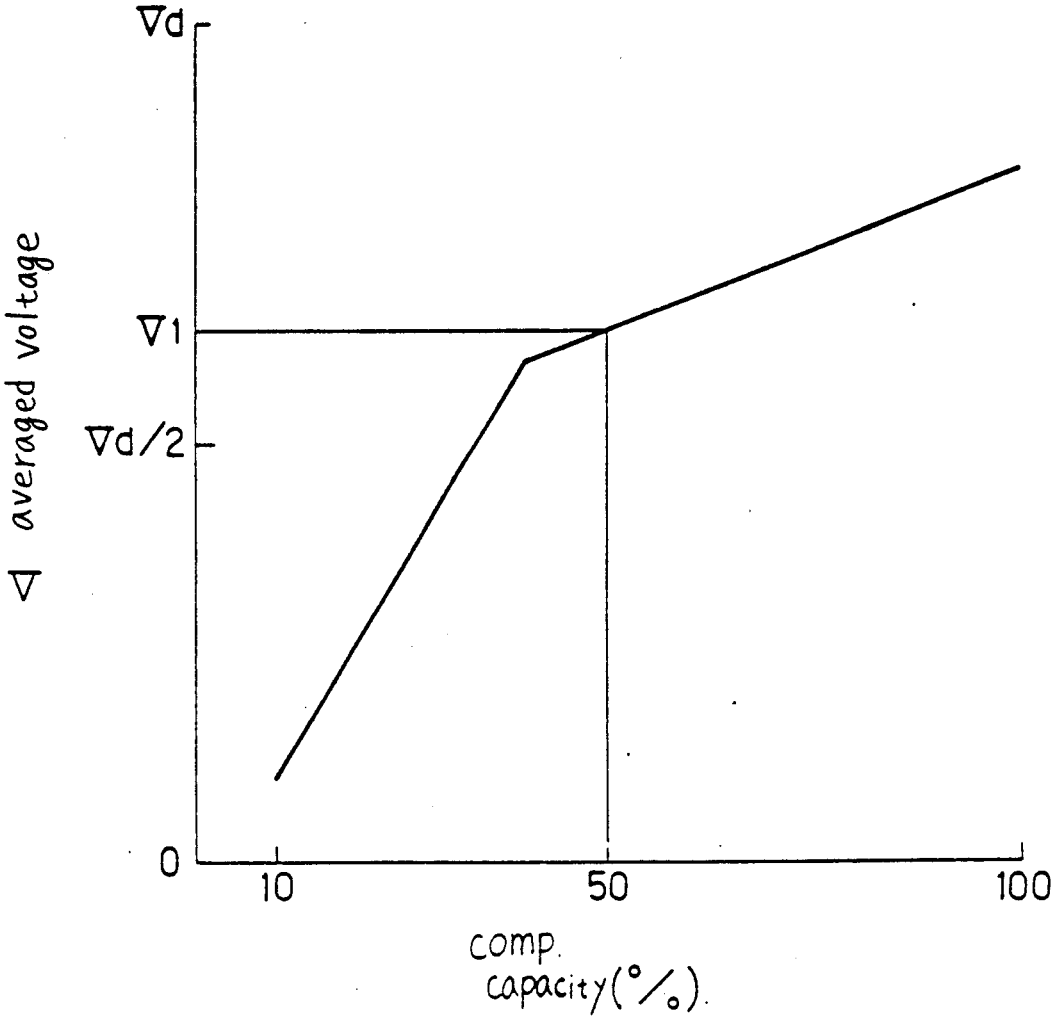
FIG. 16 shows a relationship between a discharge capacity of a compressor and an output signal.
FIG. 17 indicates an output signal.

A comparing value V1 of the step 505 is described in FIG. 16. Namely, the voltage V1 indicates the condition that the discharge capacity of the compressor is 50%. The signal output from the step 504 is compared with the comparing voltage V1 for comparing whether discharge capacity of the compressor is more than 50% or not. If the step 505 find that the discharge capacity of the compressor is more than 50%, the step 505 outputs the signal "0" as described in FIG. 17.

Figure 14:
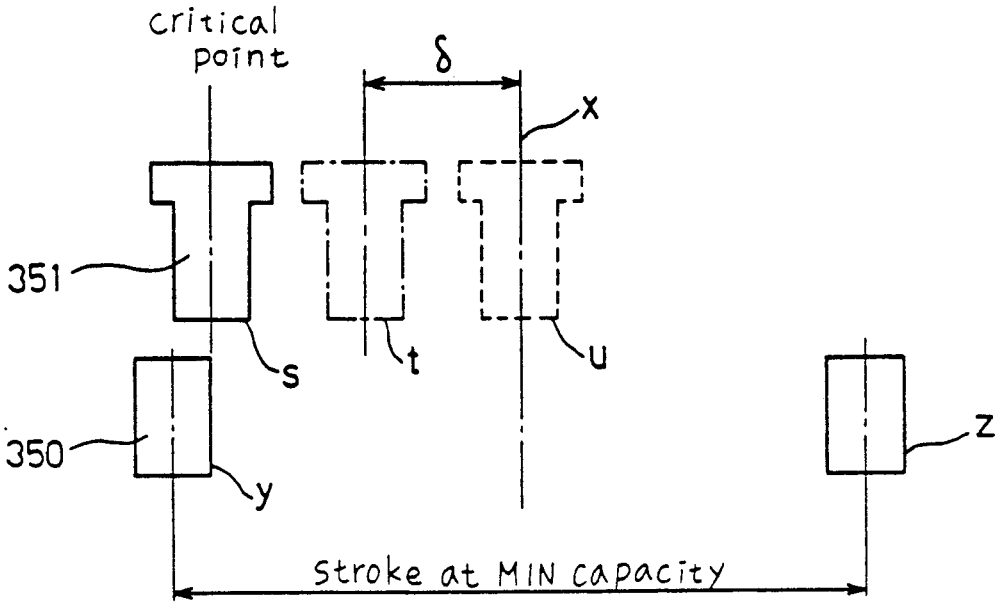
FIG. 14 shows an offset amount $\delta$ of a detector.
Figure 15:
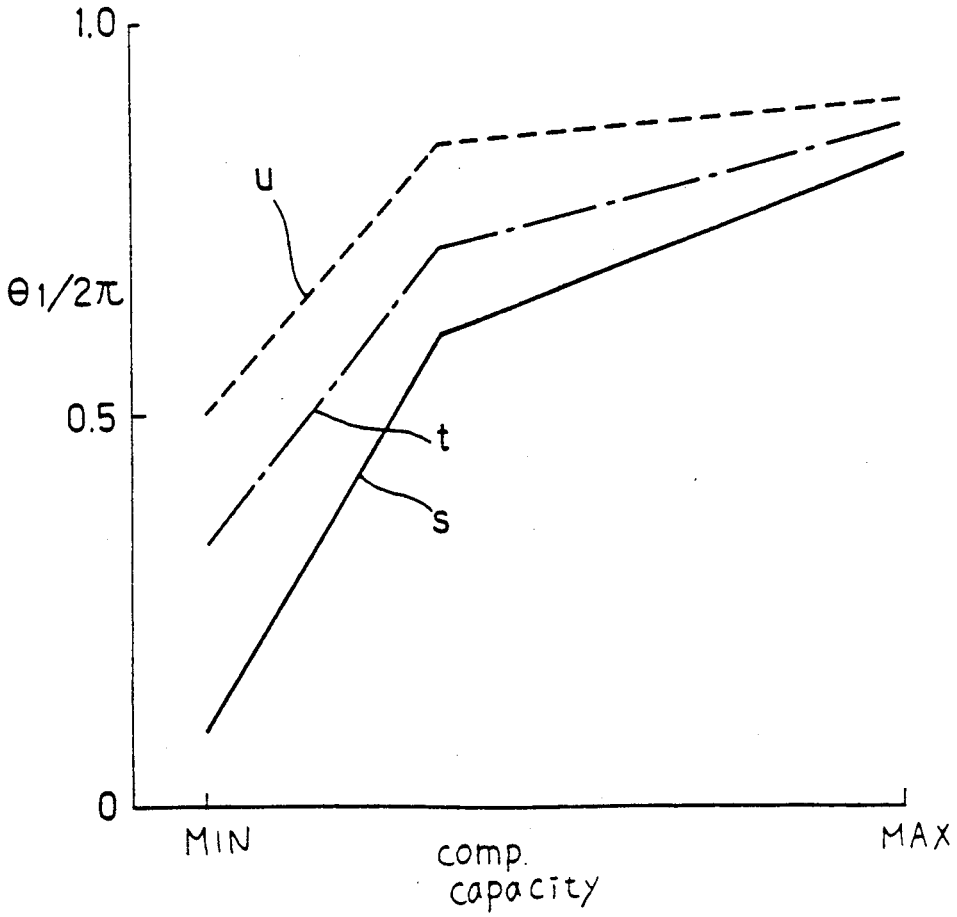
FIG. 15 shows a relationship between a position of a detector shown in FIG. 14 and an output signal thereof.

As explained above, the detector of the present embodiment can detect not only the rotation of the compressor but also the discharge capacity of the compressor. The detector of the present embodiment, however, cannot find the capacity of the compressor precisely when the capacity of the compressor is large(designated by 1 in FIG. 10), because the increment angle of line 1 is small. In order to detect the exact discharging capacity of the compressor more precisely, the increment angle of line 1 is required to be large. The increment angle of the line 1 is varied in accordance with the position of the detector 351. FIGS. 14 and 15 explain the relationship between the position of the detector 351 and the increment angle of the output relating to the ratio of $\theta 1/2\pi$. The letters y and z indicate the positions of the detected portion 350 when the detected portion 350 moves most leftwardly and rightwardly respectively while the reciprocating stroke of the piston is minimized. The interval between the point y and z indicates the reciprocating stroke of the piston. The line x shows the center point of the stroke. The detector 351 described by a dotted line u is positioned on the center portion x, the detector 351 described by a dotted line t is positioned apart from the center line x by a predetermined offset length $\delta$, the detector 351 described by a solid line s is positioned most left side. Since the detector 351 positioned left side from the position s cannot detect the detected portion 350, the position s is called as "critical point". The center point of the detector 351 at the critical point s faces the right side of the detected portion 350. The angle $\theta 1$ becomes small when the offset length $\delta$ becomes large as clearly shown from FIG. 6. Accordingly, the ratio of $\theta 1/2\pi$ becomes small when the offset length $\delta$ becomes large as shown in FIG. 15. The decrement of the ratio $\theta 1/2\pi$ is larger when the discharge capacity of the compressor is small than when the discharge capacity of the compressor is large. So that the increment angle of the line s is larger than that of the line u. In other words, the increment angle of lines s, t and u are increased in accordance with the amount of the offset length.

Figure 18:
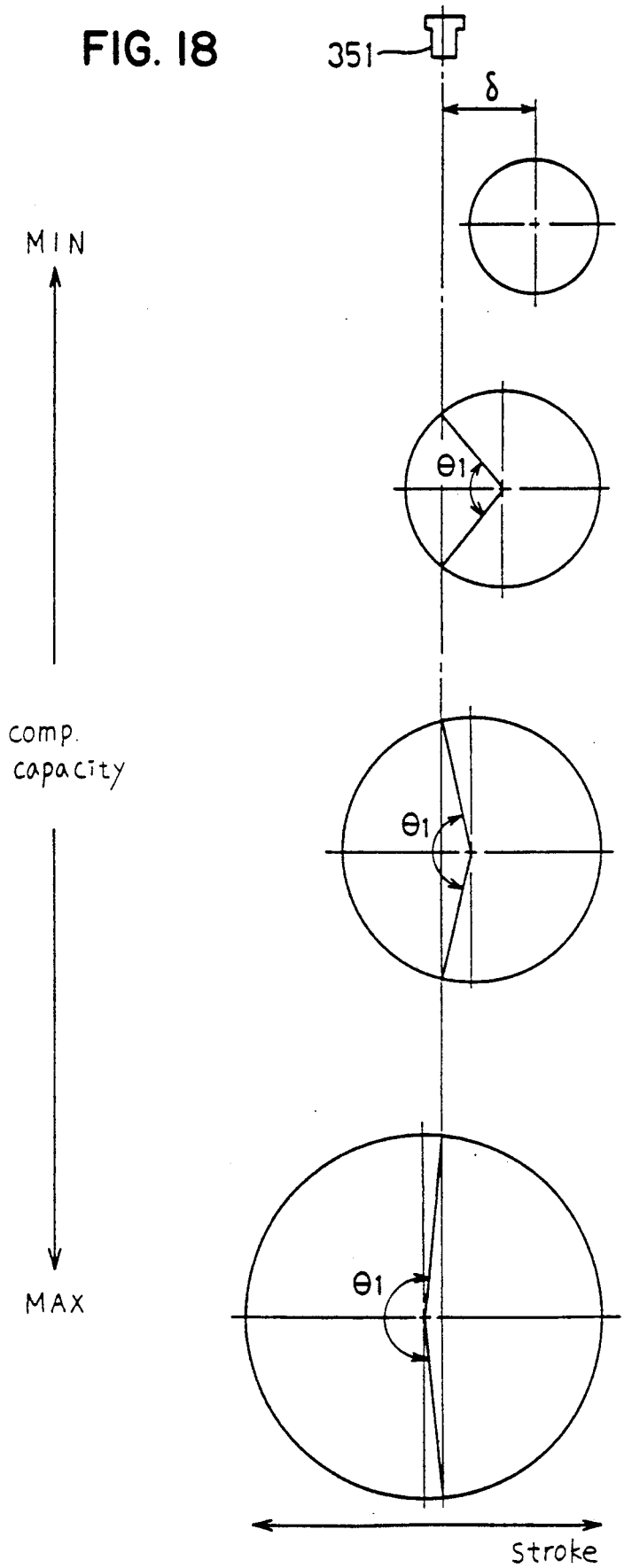
FIG. 18 shows a relationship between a reciprocating stroke of a piston and an interval $\theta 1$ of detector when the detector is positioned outside of the critical point.
Figure 19:
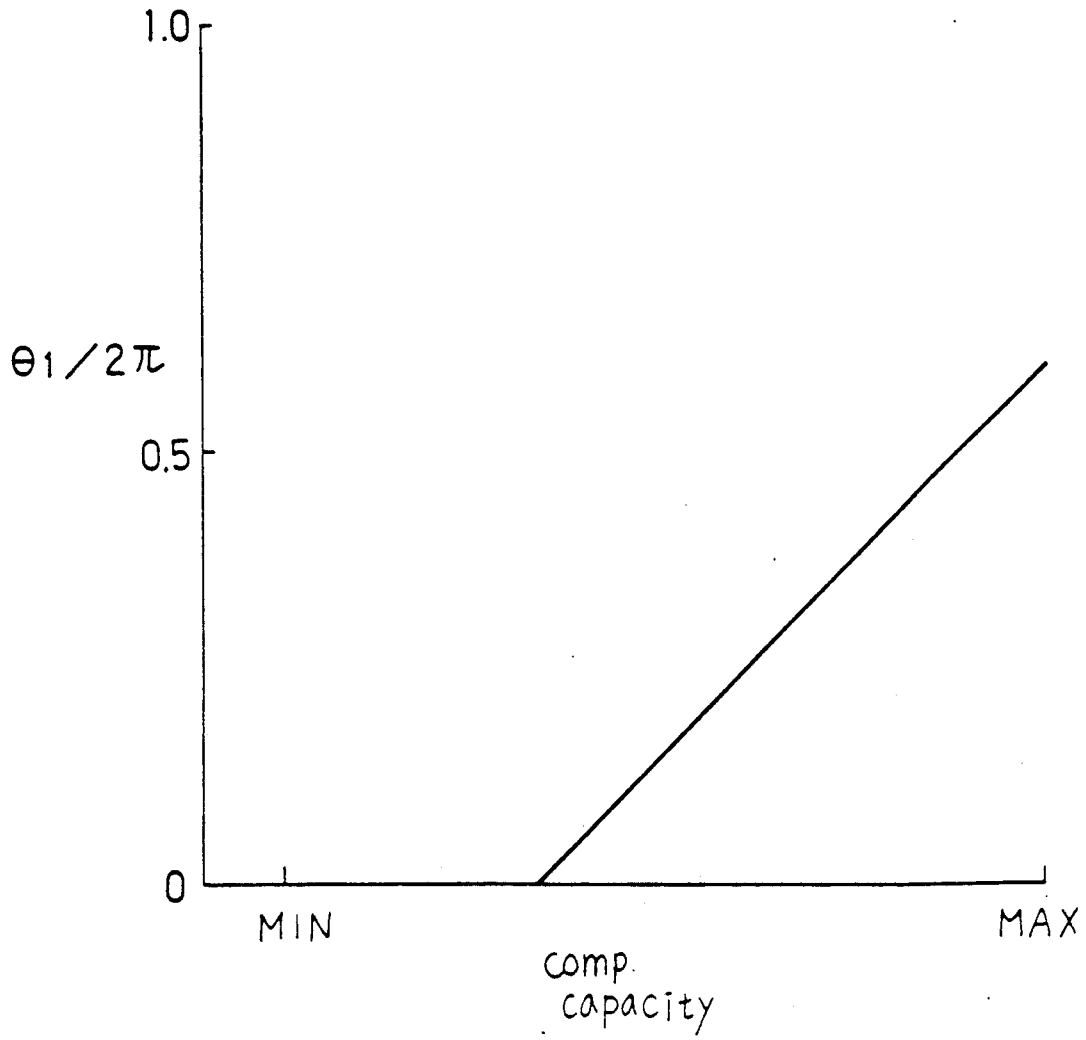
FIG. 19 shows an output signal of a detector which is provided at a position shown in FIG. 18.
Figures 20, 21:
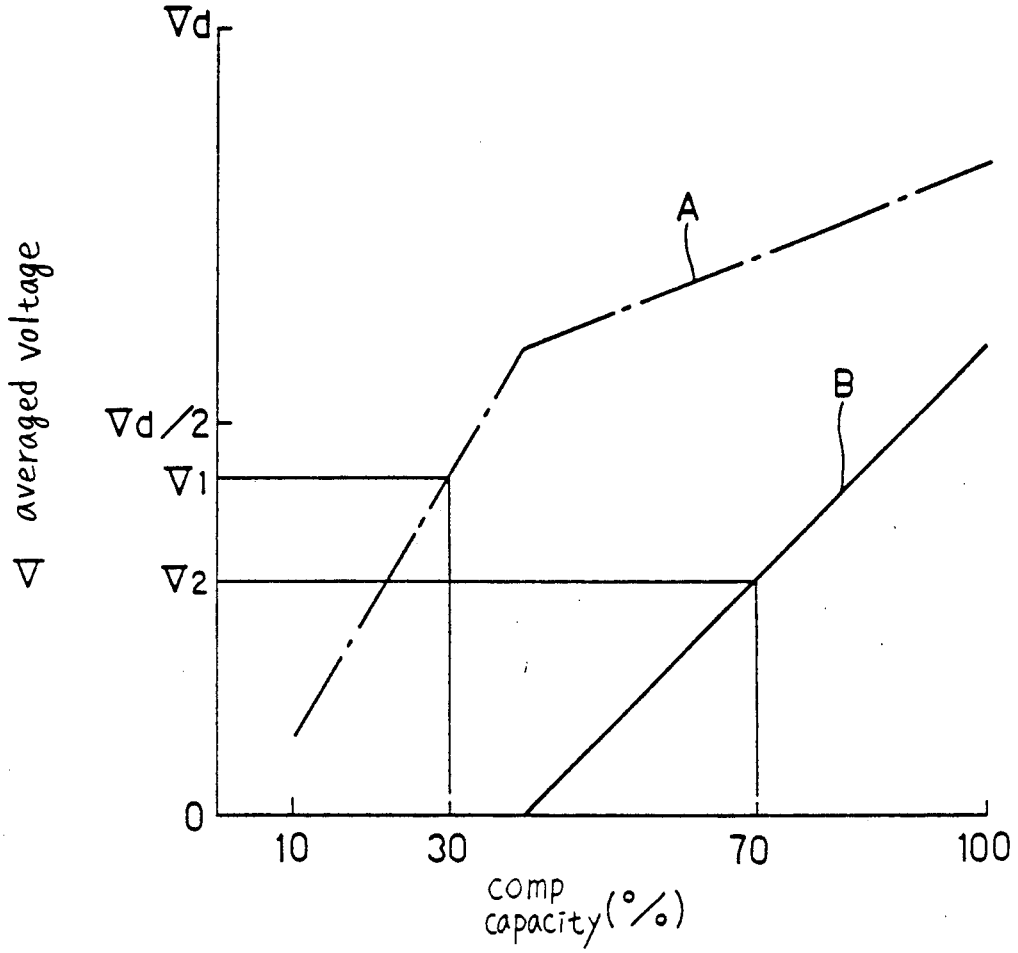
FIG. 20 shows an output signals of a couple of detectors.
FIG. 21 indicates a relationship between an output signal shown in FIG. 20 and a capacity of a compressor.

FIG. 18 shows the condition that the detector 351 is positioned left-side (the first working chamber side) from the critical point, the detector 351 cannot find the capacity of the compressor while the capacity of the compressor becomes smaller than the predetermined value. The detector 351, on the other hand, can detect the capacity of the compressor more precisely while the capacity of the compressor becomes large, as shown in FIG. 19. The increment angle of a line shown in FIG. 19 is large enough for detecting the precise capacity of the compressor, The capacity of the compressor is detected precisely from the small capacity to the large capacity when the both signals described in FIG. 15 (solid line s) and FIG. 19 are used. FIG. 20 shows the condition using a couple of signals A and B, the signal A is useful for detecting the capacity of the compressor while the small capacity, and the signal B is useful for detecting the capacity of the compressor while the large capacity. Voltages V1 and V2 indicate set values for comparing the capacity of the compressor within the "large", "medium" and "small". As shown from FIG. 21, the output 1 relating to the dotted line a of FIG. 20 outputs the signal "1" when the capacity of the compressor is smaller than 30% and outputs the signal "0" when the capacity of the compressor is larger than 30%, the output 2 relating to the solid line b in FIG. 20 outputs the signal "1" when the capacity of the compressor is smaller than 70% and outputs the signal "0" when the capacity of the compressor is larger than 70%.

Figure 22:
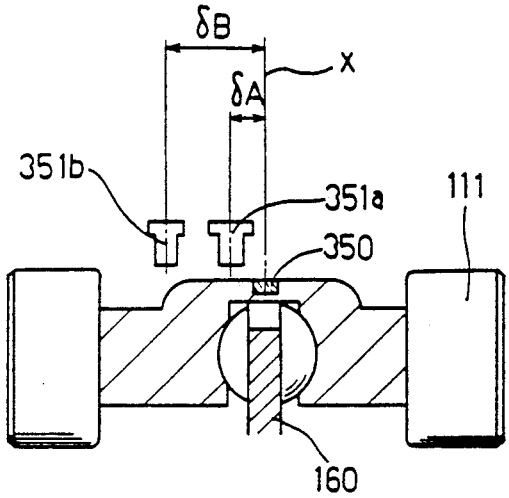
FIG. 22 is a sectional view of an embodiment employing a couple of detectors used a single piston.
Figure 23A:
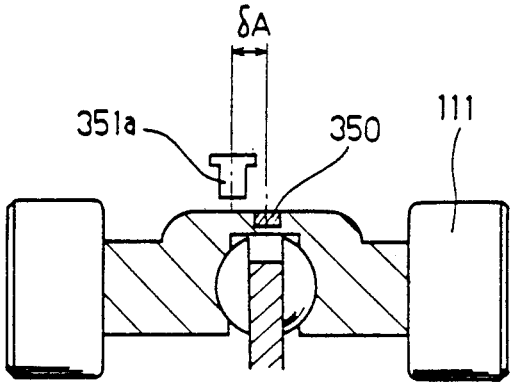
FIGS. 23*a* and *b* are sectional views of an embodiment employing a couple of detectors for each of two pistons.
Figure 23B:
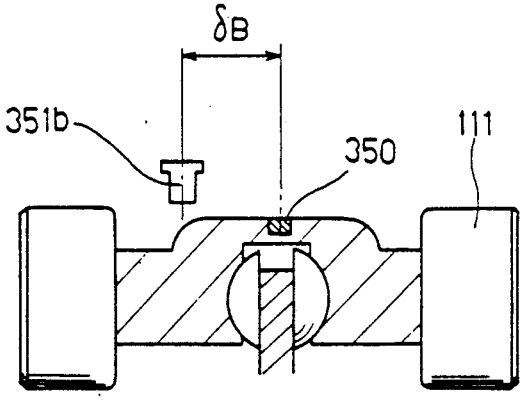

FIG. 22 shows the position of the detectors 351*a* and 351*b* which output the signals shown in FIG. 20. The detector 351*a* is positioned apart from the center line x by the offset length δA(1-2 mm, for example). The detector 351*b* is positioned leftside (the first working chamber side) of the critical point, the offset length δb between the center portion x and the detector 351*b* is about 17 mm, for example. Since the difference between the offset length δa and the offset length δb is larger than the width of the detectors 351*a* and 351*b*, a couple of detectors 351*a* and 351*b* are so mounted on the cylinder block that the both detectors 351*a* and 351*b* face to the same piston 111. The detectors 351*a* and 351*b* are, of course, so positioned on the cylinder block that each detector faces the different piston 111, as shown in FIG. 23.

Figure 24:
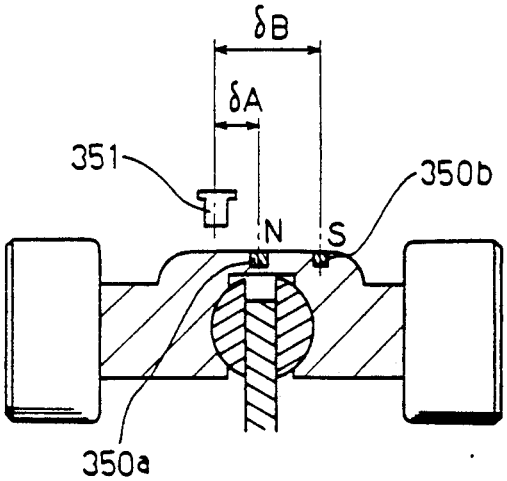
FIG. 24 is a sectional view of an embodiment employing a couple of magnets provided on a single piston.
Figure 25B:
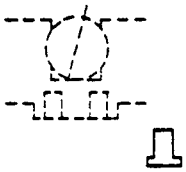
FIGS. 25*a–c*, 26*a–c* and 27*a–c* show an output signal of an electromagnetic sensor.
Figure 25C:
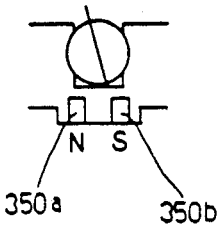
Figure 25A:
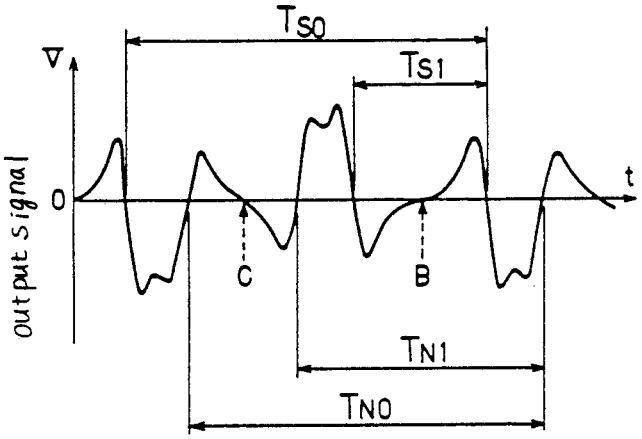
Figure 26B:
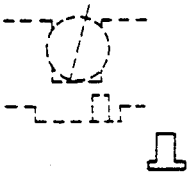
Figure 26C:
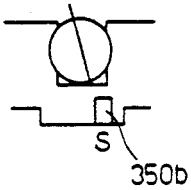
Figure 26A:
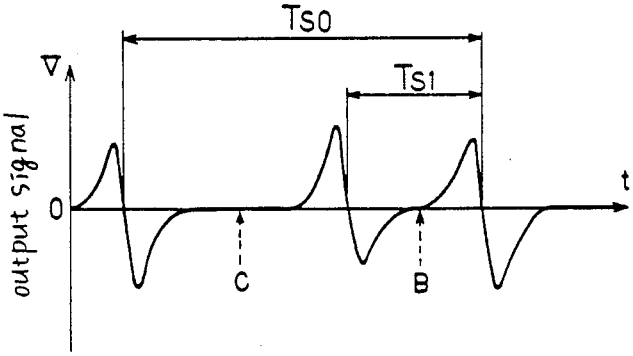
Figure 27B:
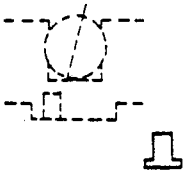
Figure 27C:
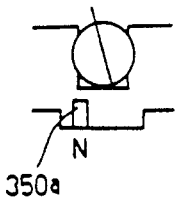
Figure 27A:
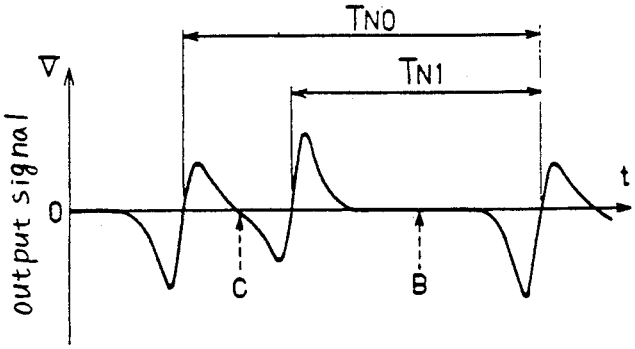
Figure 28C:
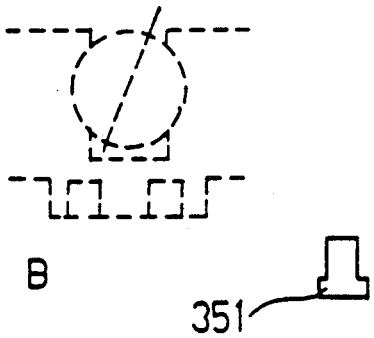
FIGS. 28*a–d* show relationships between an output signal of an electromagnetic sensor and an integrated wave thereof.
Figure 28D:
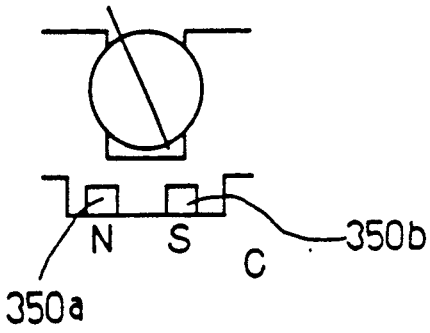
Figure 28A:
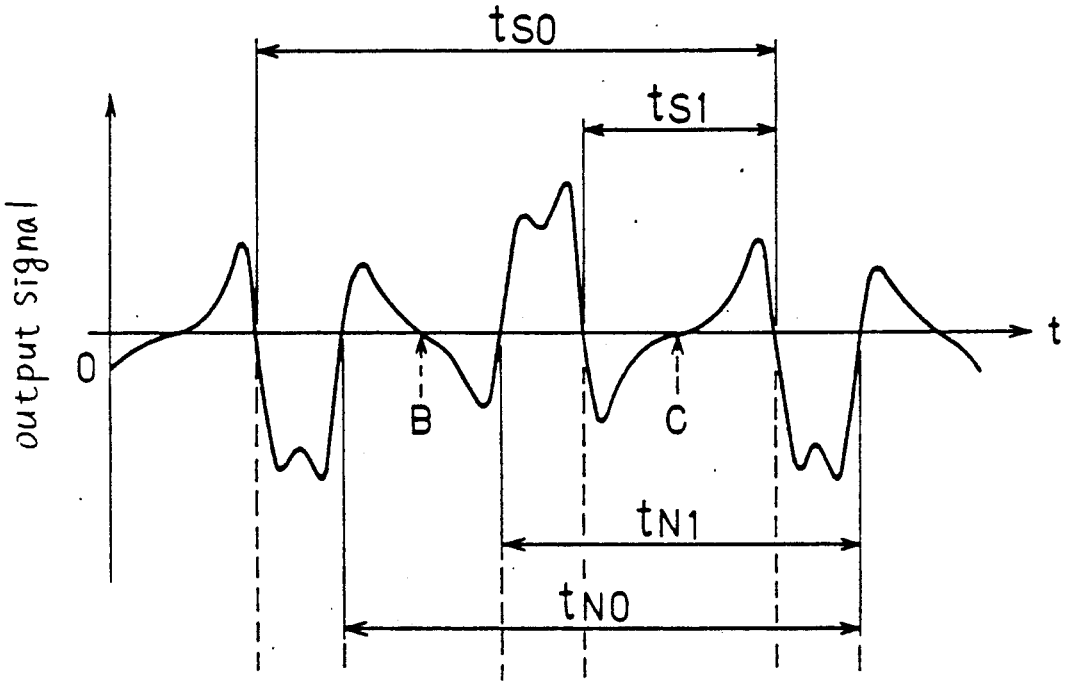
Figure 28B:
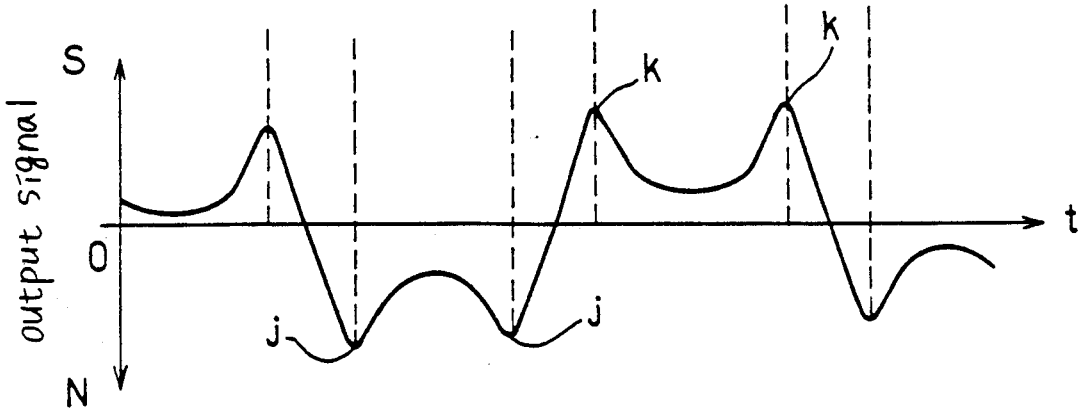

FIG. 24 shows the other embodiment which uses a single detector for detecting a couple of signals such is the same as shown in FIG. 20. A couple of magnets 350*a* and 350*b* are used as the detected portion. The magnetic pole of the first magnet 350*a* facing to the detector 351 is "N" and that of second magnet 350*b* is "S". The position of a couple of magnets 350*a* and 350*b* are same as those of the detectors 351*a* and 351*b* described in FIG. 22. FIG. 25 shows an output wave indicating the change of the magnetic flux caused by both magnets 350*a* and 350*b*, the output wave shown in FIG. 25 is divided to a signal caused by the second magnet 350*b* (shown in FIG. 26) and a signal caused by the first magnet 350*a* (shown in FIG. 27). Since the output voltage of the detector is calculated by the following formula, the magnetic flux $\phi$ is calculated by integrating the output signal of the detector 351

$$V = -n\frac{d\phi}{dt}$$

Figure 29:
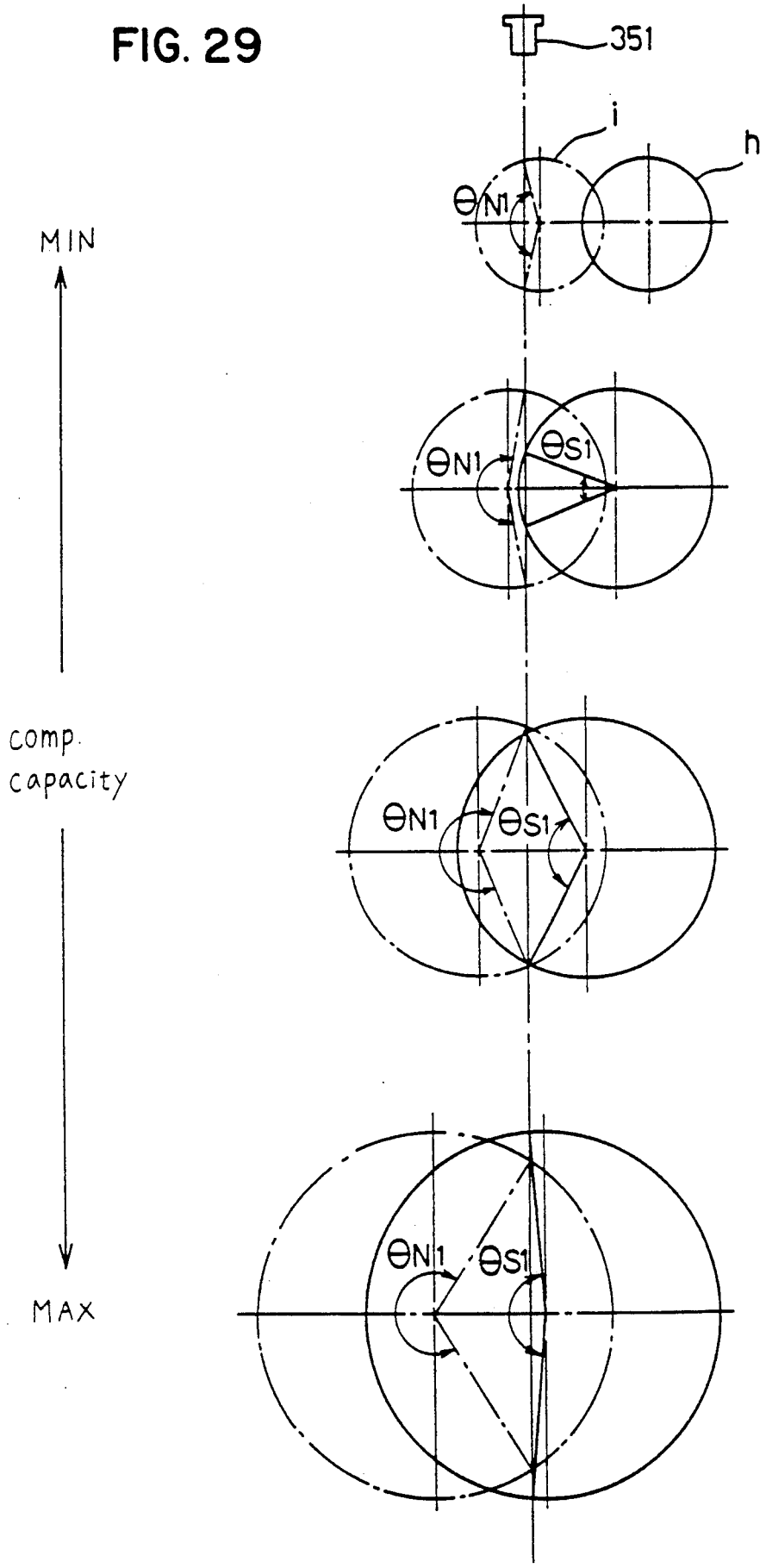
FIG. 29 shows a relationship between a reciprocating stroke of a magnet shown in FIG. 24 and an interval angle $\theta 1$ of a detector.
Figure 30:
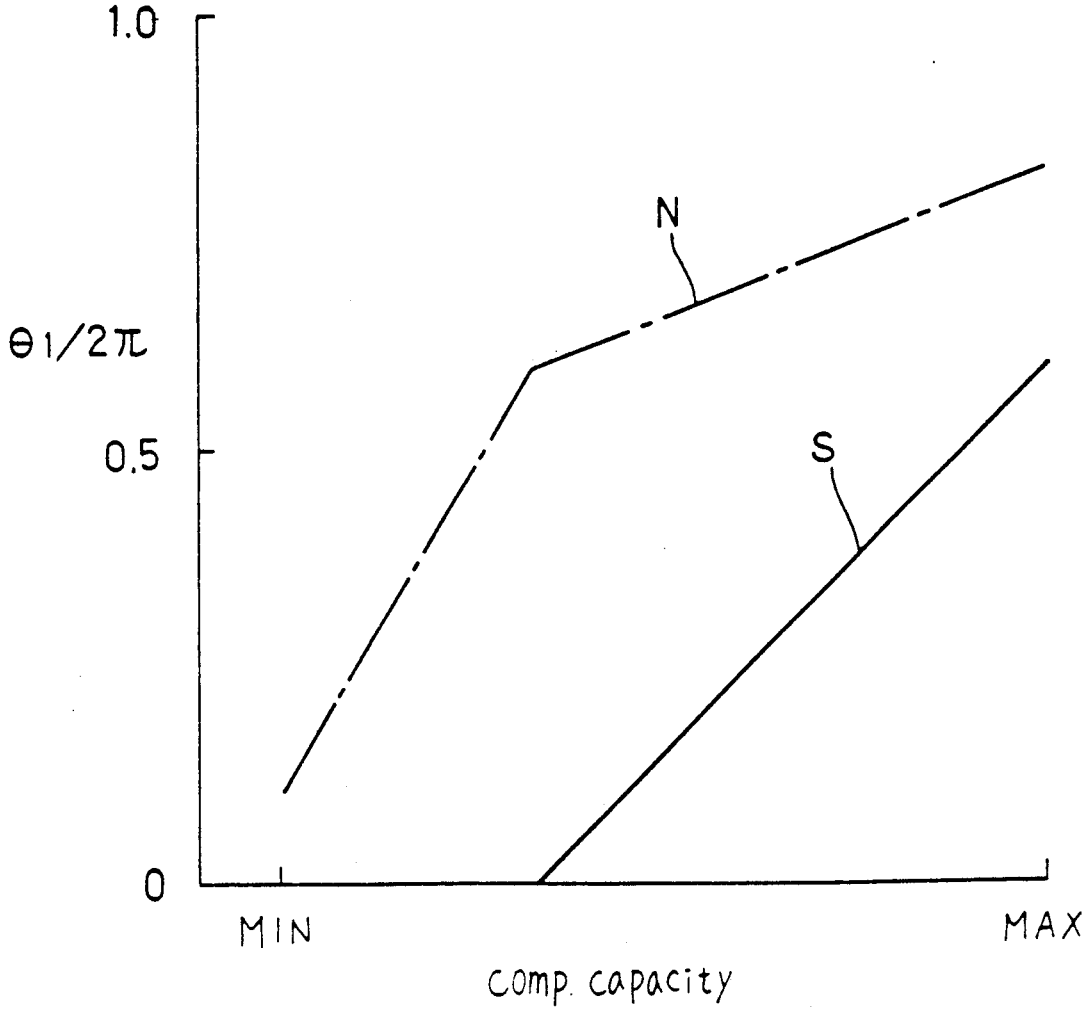
FIG. 30 shows an output signal of a detector shown in FIG. 29.

V . . . voltage
n . . . number of wound wire
$\phi$ . . . magnetic flux
t . . . time FIG. 28 shows an integrated signal of an output voltage from the detector 351. The point b in FIGS. 25-28 shows the condition that the piston 111 moves most leftwardly (the first working chamber side) and the position c shows the condition that the piston moves most rightwardly ( the second working chamber side). A peak K indicates the condition that the second magnet 350*b* passes through the detector 351, and a peak j indicates the condition that the first magnet 350*a* passes through the detector 351. The reciprocating strokes of a couple of magnets are shown in FIG. 29, the solid line h indicates the reciprocating circle of the second magnet 350*b* and dotted line i indicates the reciprocating circle of the first magnet 350*a*. The diameters of the circles h and i indicate the reciprocating stroke and velocity of the magnets. The angles θn1 and θs1 are also varied in accordance with the diameter of the circles i and h. Therefore, a single detector 351 can detect the discharge capacity of the compressor an output signal of which is described in FIG. 30.

Figure 31:
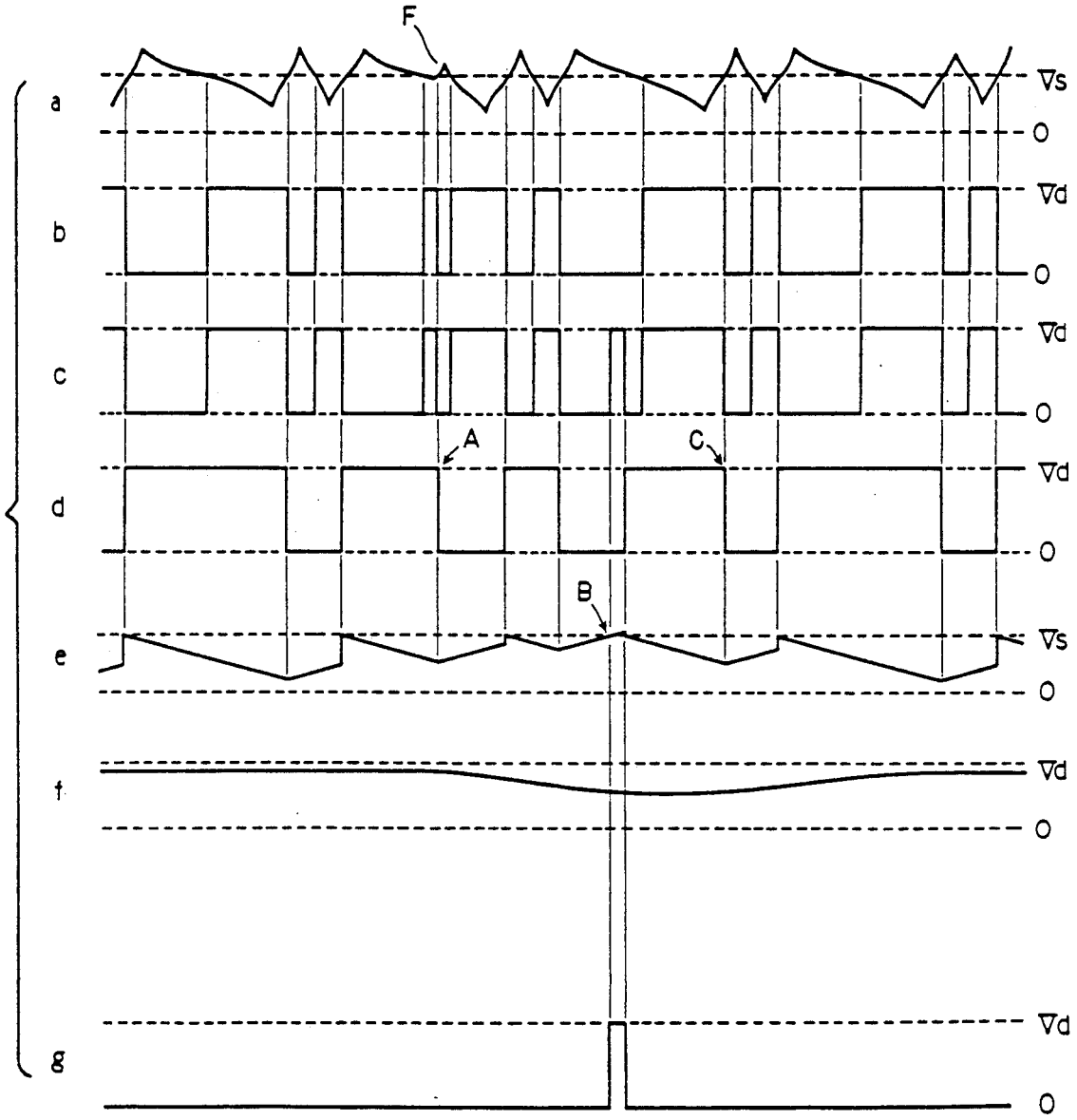
FIG. 31 shows output signals of the a controlling circuit where a noise is included in an output of a detector.

An output signal of the detector 351 may include some noise. Though a small noise can be eliminated by the resister 520, large noise which is usually caused by the ignition of the automotive engine may not be eliminated by the resister 520 and such large noise causes damages for the output signal of the detector 351. As shown in FIG. 31, the noise F included in the output signal of the detector makes the rectangular wave shape after the output is shaped by the step 502 so that the rectangular wave should be reversed, and such reversed signal cannot indicate the exact discharge capacity of the compressor.

Figure 32:
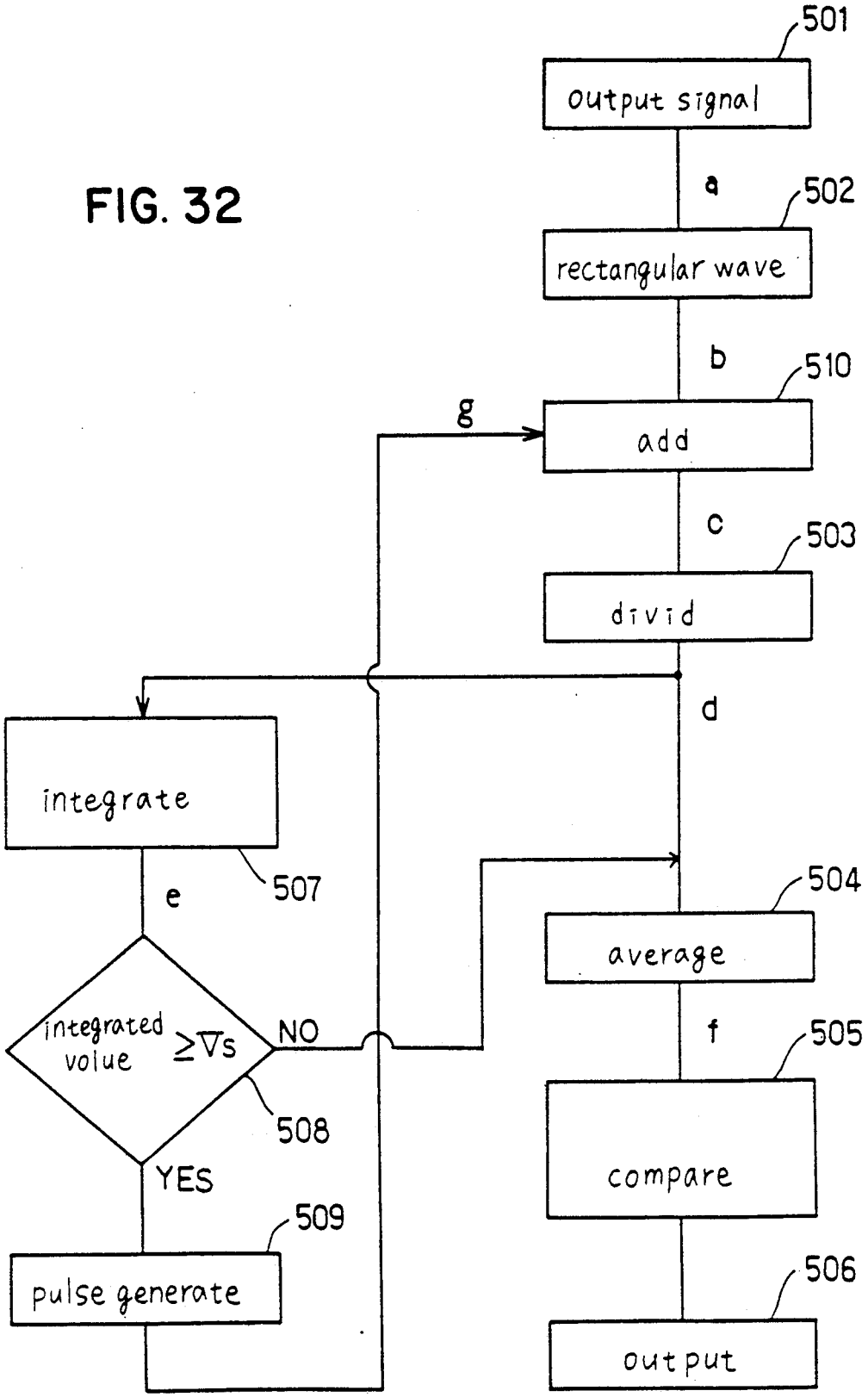
FIG. 32 is a flow-chart of a controlling circuit shown in FIG. 9 but including a noise cancelling function.
Figures 33A, 33B:
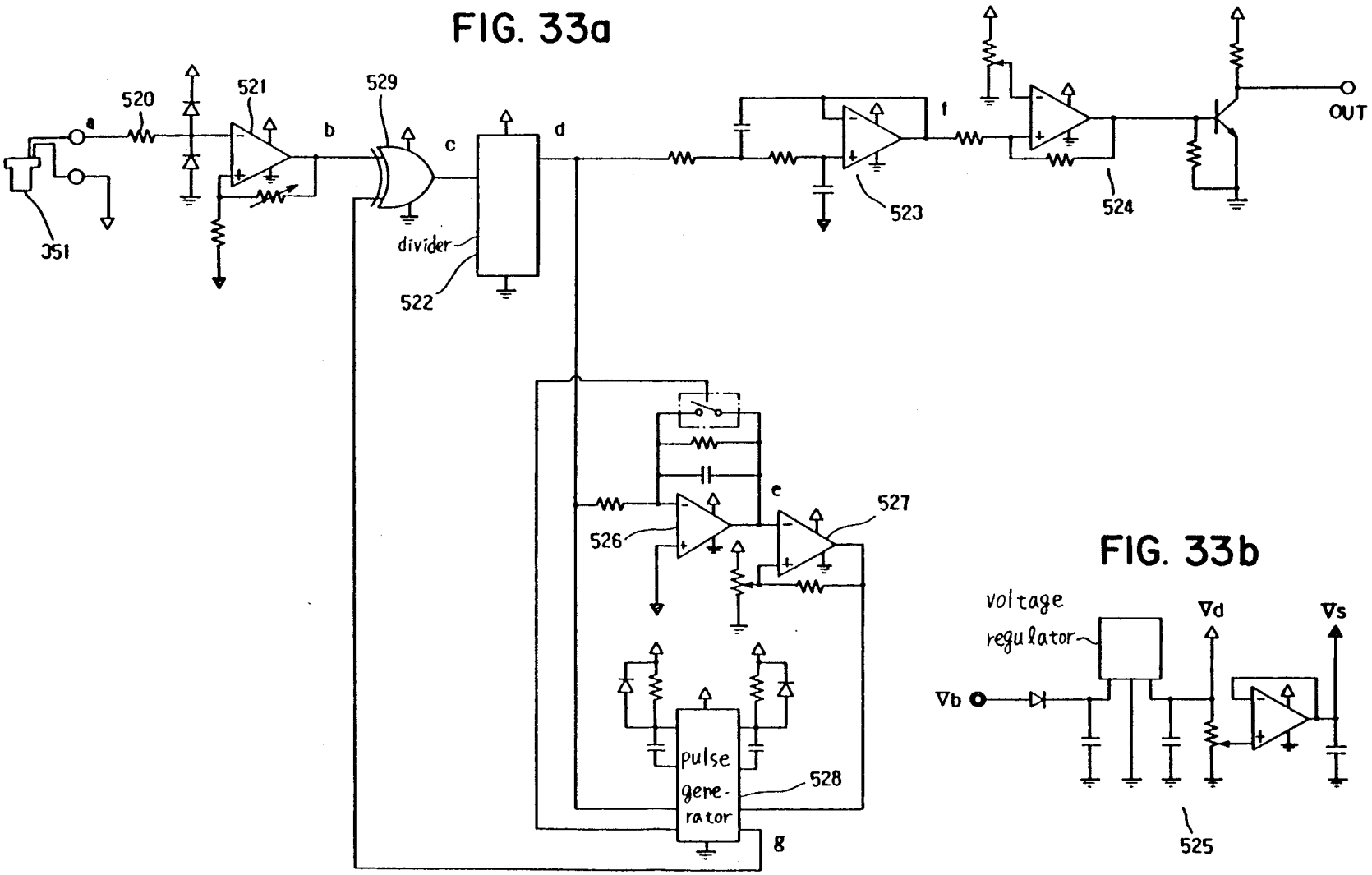
FIGS. 33*a* and *b* show an electric circuit which completes a function shown in FIG. 32.

FIG. 32 shows the controlling flow for eliminating the noise F. The output signal d output from the step 503 is integrated by a step 507, therefore the output signal e from the step 507 should be increased even when the output signal a of the sensor 501 is decreased even when the noise F makes the signal d reverse. Accordingly, a step 508 can detect the reverse signal by comparing the integrated signal e with a predetermined set value Vs. The step 508 decides that no large noise F is included in the output signal a when the integrated signal e is smaller than the predetermined set value Vs. The routine from the step 507 returns to the step 504 when the step 508 finds no noise F. The step 508 decides, on the other hand, the output signal a includes the noise F when the integrated signal e is larger than the predetermined set value Vs. The pulse generated by a step 509 is added to the output signal b by a step 510 for cancelling the noise F. FIG. 33 shows the electric circuit by which the routine described in FIG. 32 is carried out. The integrated circuit 521 integrates the output signal d from the divider 522, and the integrated signal e is compared by the comparing circuit 527. The pulse is generated by a generator 528 when the comparing circuit 527 finds the integrated signal e is larger than the set value voltage Vs. The adder 529 adds the pulse to the output signal d from the wave shaped circuit 521. The output signal "0" or "1" from the rectangular wave shaping circuit 521 is input to the divider 522 when no signal is added from the pulse generator 528, the output signal "0" or "1" from the wave shaping circuit 521, on the other hand, is reversed by the circuit 529 when the pulse generated by the pulse generator 528 is input to the adder 529.

Figure 34:
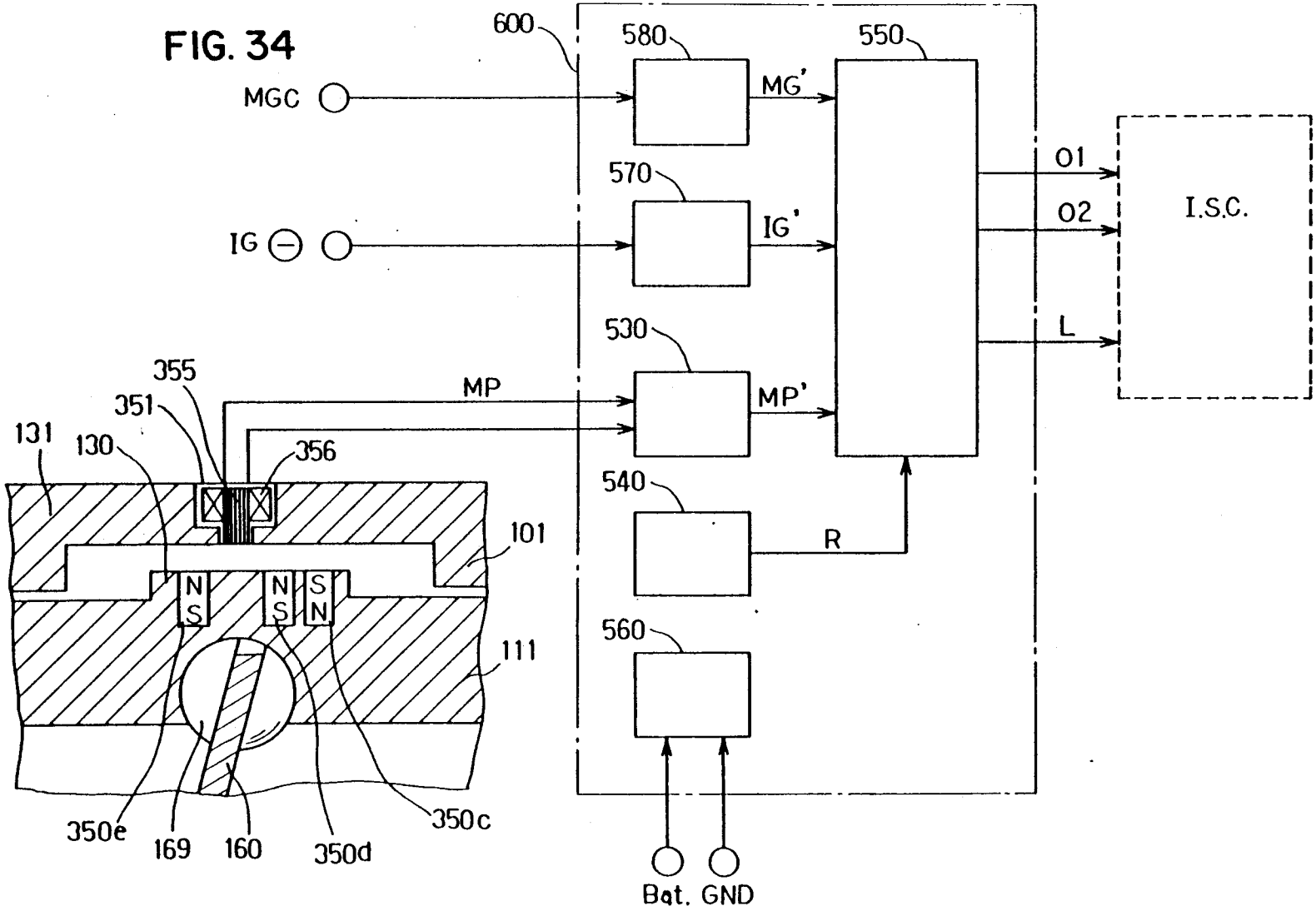
FIG. 34 is a sectional view showing another embodiment of a present invention.
Figure 35:
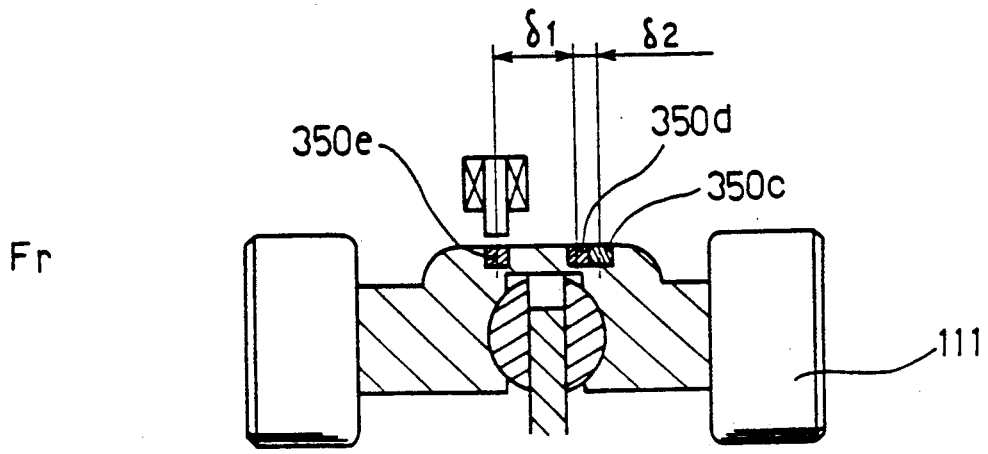
FIG. 35 is a sectional view showing an offset length $\delta_1$ and $\delta_2$.
Figure 36:
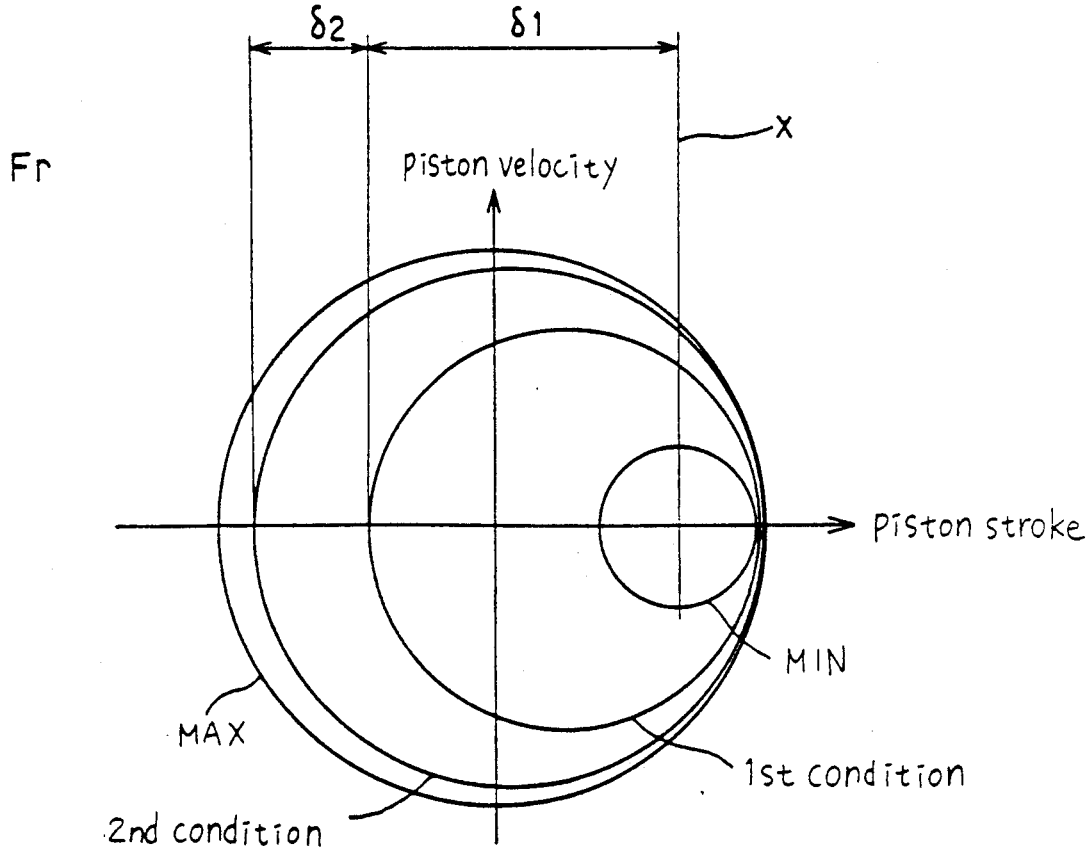
FIG. 36 shows a relationship between an offset length $\delta_1$ and $\delta_2$ and reciprocating stroke of a piston.
Figure 37:
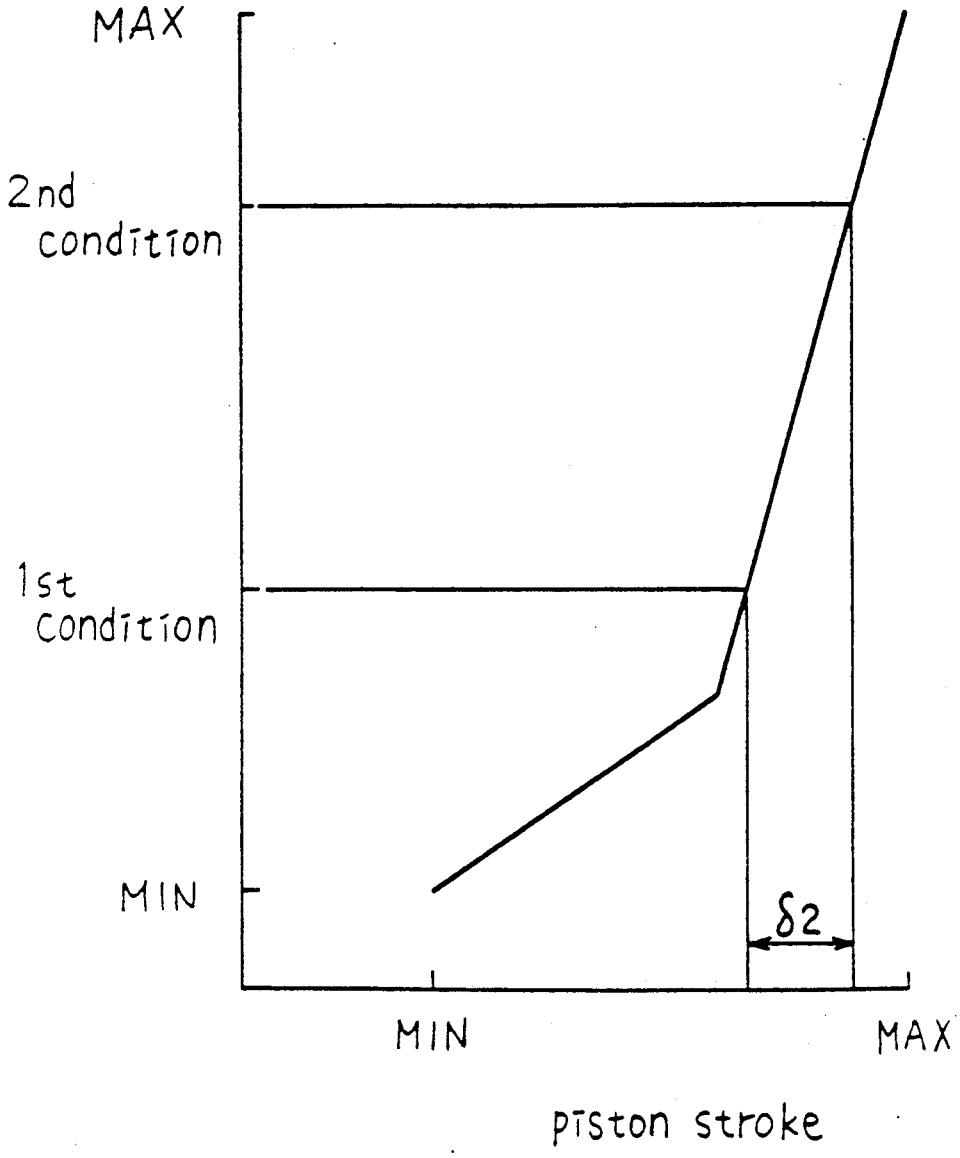
FIG. 37 shows a relationship between a reciprocating stroke of a piston and a set value of a compressor capacity.

Though the controlling circuit of the above described embodiment shows the capacity of the compressor as the voltage level which is varied continuously, the capacity of the compressor can be calculated by the number of the pulses generated when the magnet 350 passes through the detector 351. FIG. 34 shows an embodiment for calculating the capacity of the compressor by using the counted number of the pulse. Magnets 350*c*, 350*d* and 350*e* are mounted in the holding portion 130 of the piston 111 as the detected portion. The magnetic pole of the magnet 350*c* which locates most the second working chamber 171 side is different from the remaining two magnets 350*d* and 350*e*. Namely, the magnetic pole of the detector 350 side of the magnet 350*c* is "S", and that of the other magnets 350*d* and 350*e* are "N". Numeral 355 in FIG. 34 shows the shaft made of magnetic substance, and a numeral 356 indicates a coil wound around the shaft 355. The position of the magnets 350*c*, 350*d* and 350*e* is explained by referring FIGS. 35 and c36. The offset length δ 1 is the same as the offset length between the center portion x and the bottom dead point of the reciprocating stroke while the stroke of the piston 111 becomes minimize. The offset length δ 2 is identified with the offset length between the bottom dead point at the first condition and the bottom dead point of a second condition. The interval between the second magnet 350*d* and the third magnet 350*e* is equal to the offset length δ 1 and the interval between the first magnet 350*c* and the second magnet 350*d* is equal to the offset length δ 2. The detector 351 is positioned at the center portion x of the reciprocating stroke of the second magnet 350*d* when the reciprocating stroke of the piston is minimized. The first condition is the condition that the capacity of the compressor is about 40%, and the second condition is the condition that the capacity of the compressor is about 80%. The difference δ 2 of the reciprocating strokes of the piston between the first condition and the second condition is not so large enough as shown in FIG. 37, so that the offset length δ 2 is about 4mm when the offset length δ1 is set about 15 mm. The diameter of the magnets 350*c* and 350*d* needs at least 4 mm for outputting a predetermined level of the signal so that the first magnet 350*c* and the second magnet 350*d* should be positioned closed each other.

Figure 38B:
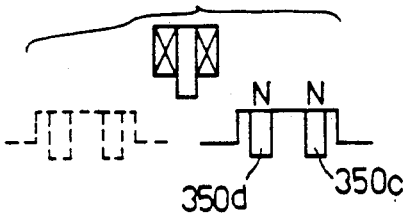
FIGS. 38*a–b*, 39*a–b*, 40*a–b* and 41*a–b* show an output signal of a detector position of a magnet is varied from each other.
Figure 38A:
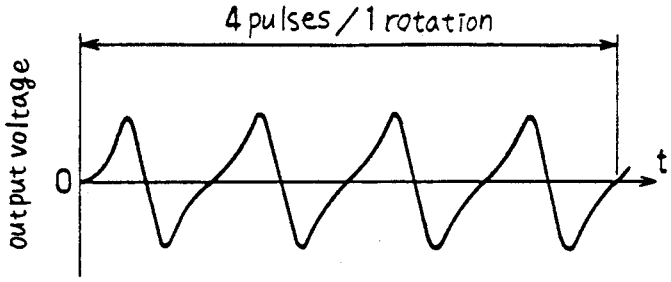
Figure 39B:
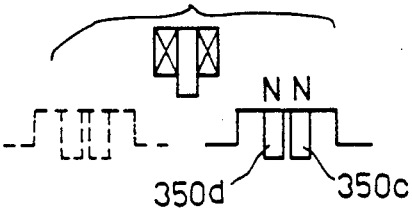
Figure 39A:
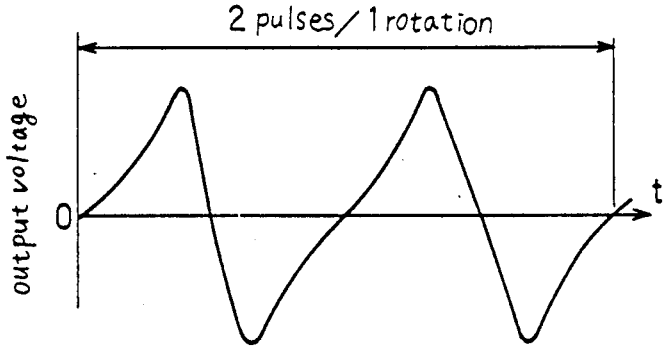
Figure 40B:
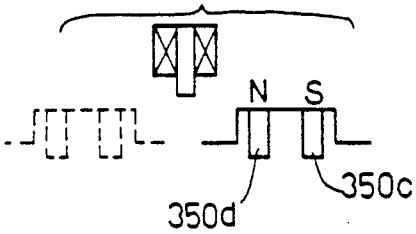
Figure 40A:
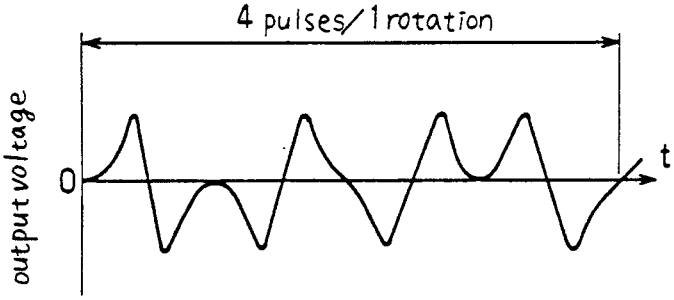
Figure 41B:
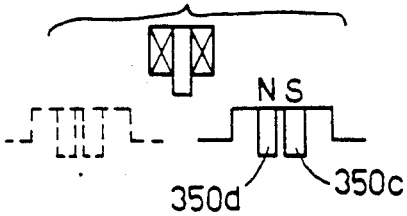
Figure 41A:
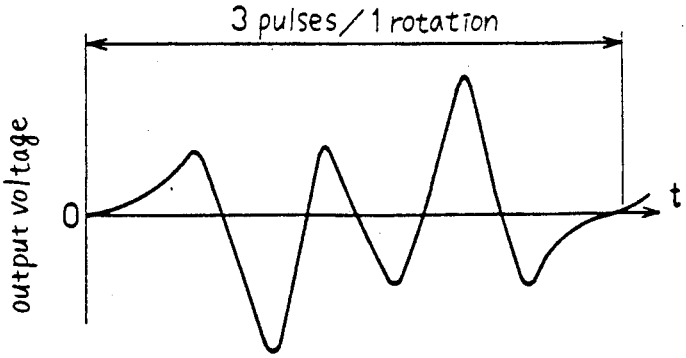

The magnets 350*c* and 350*d* can output four pulse within a one reciprocating cycle when these two magnets 350*c* and 350*d* are apart from each other by the enough offset length, as shown in FIG. 38. The magnets 350*c* and 350*d*, on the other hand, can output only two pulse within one reciprocating cycle when both magnets 350*c* and 350*d* are positioned close to each other, as shown in FIG. 39. FIGS. 40 and 41 show the condition that the magnets 350*c* and 350*d* are positioned in such a manner that the magnetic pole of the magnets are different from each other. As shown from FIG. 41, the magnets 350*c* and 350*d* can generate three pulse during one reciprocating cycle even when both magnets 350*c* and 350*d* are positioned close to each other.

Figure 42A:
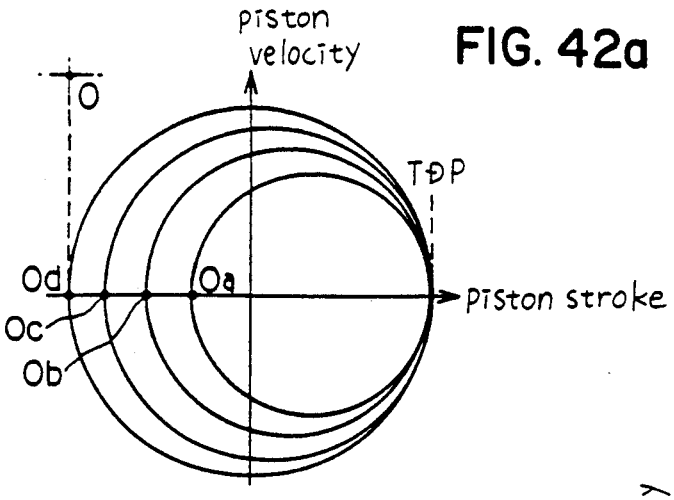
FIGS. 42*a–c* show an output signal of a detector shown in FIG. 34.
Figure 42B:
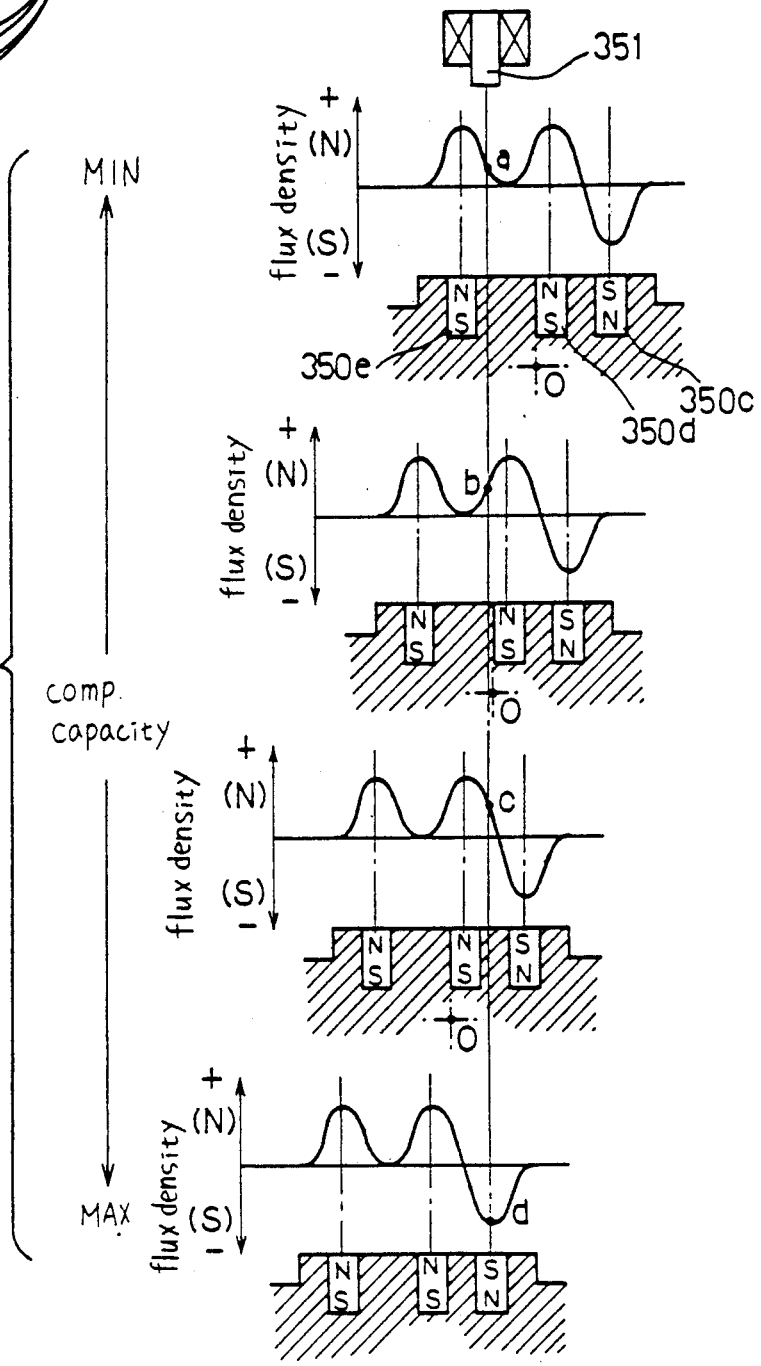
Figure 42C:
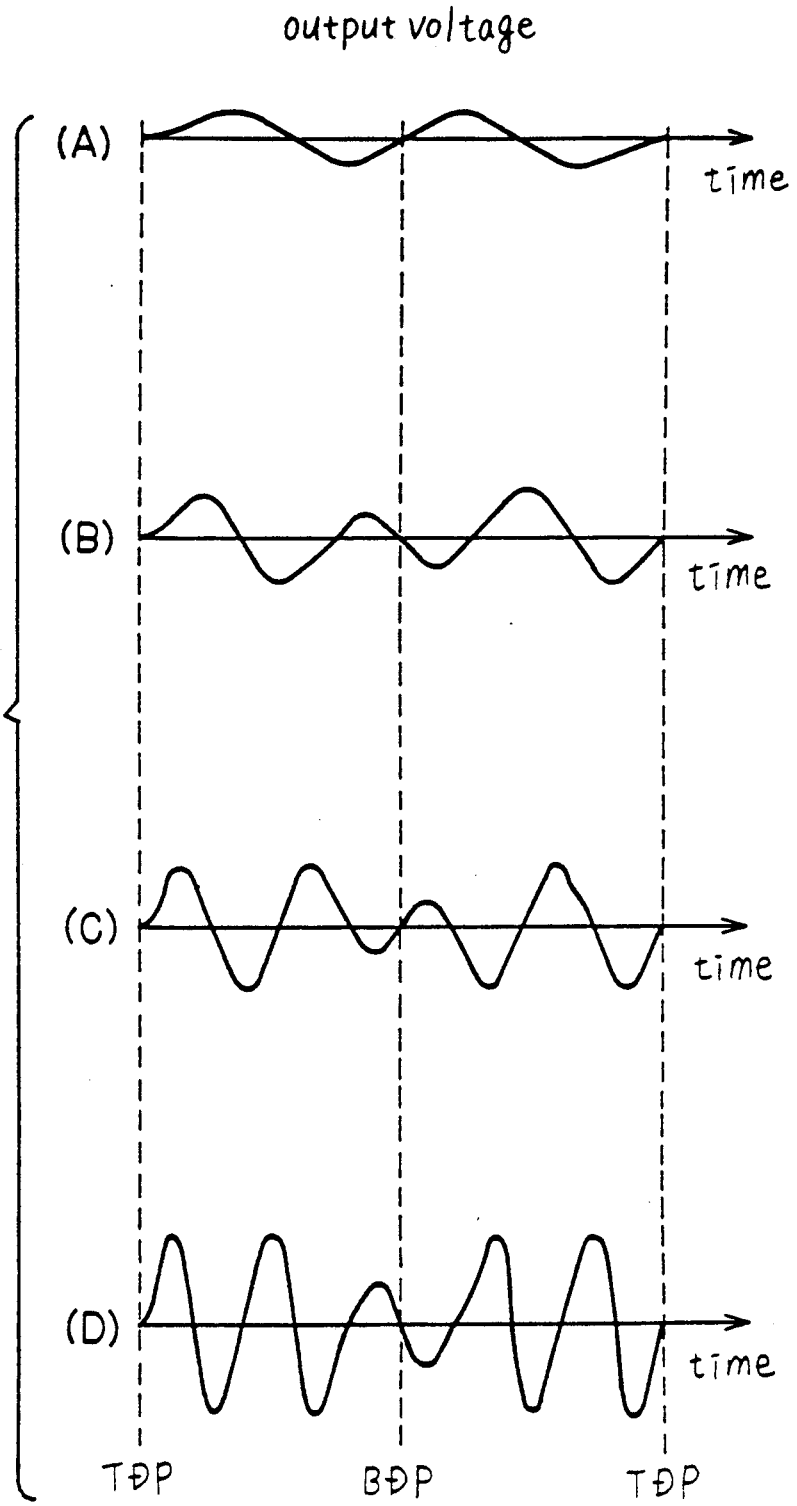

As the reasons explained above, the magnetic pole of the magnet 350*c* is different from that of the other two magnets 350*d* and 350*e*. FIG. 42 shows the output signal of the detector, FIG. 42A shows an reciprocating cycle of the piston 111 as a circuit. The point Oa indicates the bottom dead point at a smallest capacity of the compressor, the point Ob shows the bottom dead point at the first condition (40% capacity), a point Oc shows a bottom dead point at the second condition (80% capacity), and a point Od shows a bottom dead point at the maximum capacity of the compressor. Only the third magnet 350*e* can pass through the detector when the capacity of the compressor is minimized as shown in the top line of FIG. 42(A) and 42(B). So that the detector 351 generates two pulses while one reciprocating cycle. The detector 351 can detect one piece of the change of the magnetic density while the piston 111 moves from its top dead point to its bottom dead point, the velocity of the piston becomes 0 when the piston 111 positions at its dead point. The detector 351 also can detect one price of the change of the magnetic density when the piston 111 moves from its bottom dead point to its top dead point. Accordingly, the detector can detect two waves of the output signal while the shaft rotates one cycle as shown in this line. A point a in FIG. 42 indicates the position of the piston's bottom dead point when the reciprocating stroke of the piston is minimized, a point b in FIG. 42 indicates the position of the bottom dead point of the piston when the reciprocating stroke of the piston is the first condition (small amount), a position c indicates the bottom dead point when the reciprocating stroke of the piston is the second condition (medium amount), and a point d indicates the bottom dead point of the piston when the reciprocating stroke of the piston is maximized. As shown from FIG. 42(A), 42(B), the detector 351 output two signals when the reciprocating amount is minimized, the detector 351 outputs three pulses when the discharge amount of the compressor is the first condition, the detector 351 outputs four pulses when the amount of the compressor is the second condition, and the detector 351 outputs five pulses when the capacity of the compressor is maximized. Accordingly, the capacity of the compressor is calculated by counting the number of the pulses as shown in FIG. 43.

The output signal MP from the detector 351 is input to the controlling circuit 600 which employs a first rectangular wave shaping circuit 530 by which a pulse signal output from the detector is shaped to be rectangular wave, a second rectangular wave shaping circuit 520 by which the igniting signal ID of the engine is shaped to be rectangular wave, a third rectangular wave shaping circuit 560 by which an on/off signal of the electromagnetic crutch MGC is shaped to be rectangular wave, a calculating circuit 550 by which the capacity of the compressor is calculated, a reset circuit 540 by which the controlling circuit 600 is reset when the main electric power switch is turned on, and a battery circuit 560. The one terminal of the battery circuit 560 is connected to a battery, the other terminal of the circuit 560 is grounded. The output signal of the calculating circuit 550 is supplied to an idling speed controller ISC of the automotive engine. The output signals 01 and 02 shown in FIG. 34 indicate the capacity of the compressor and the output signal L indicates the extraordinary condition of the compressor. Each of the circuits 530, 570, 580, 540 and 560 is described in FIGS. 44–48.

Figures 43, 44:
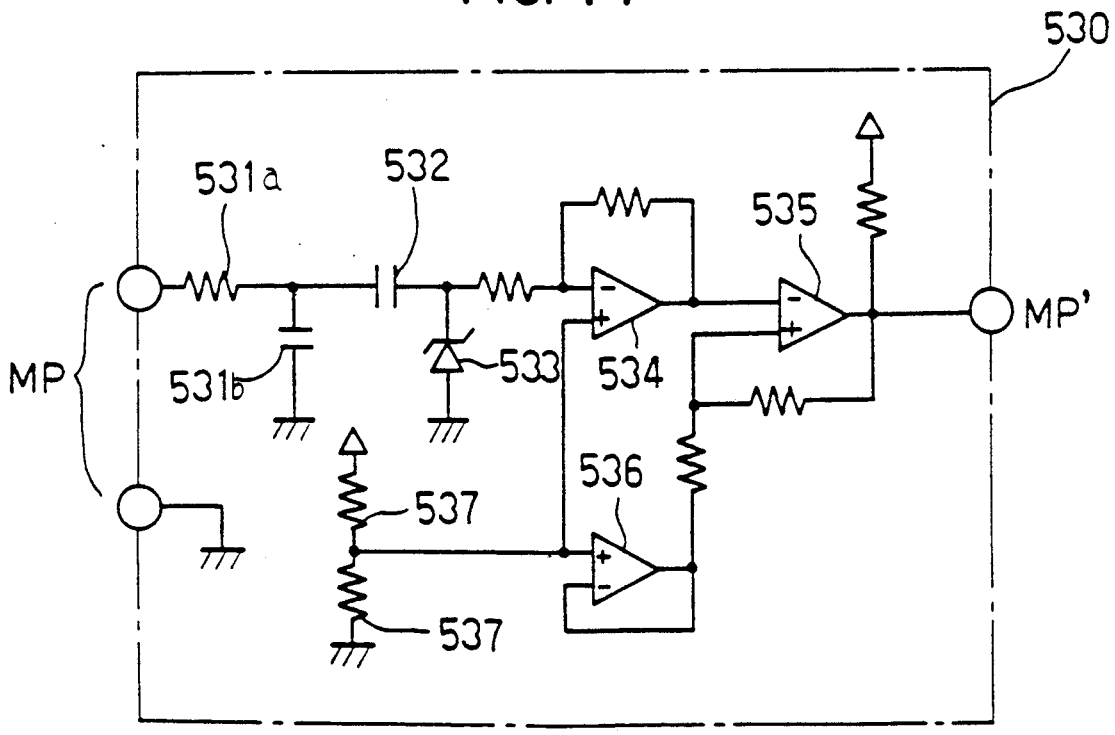
Figure 49:
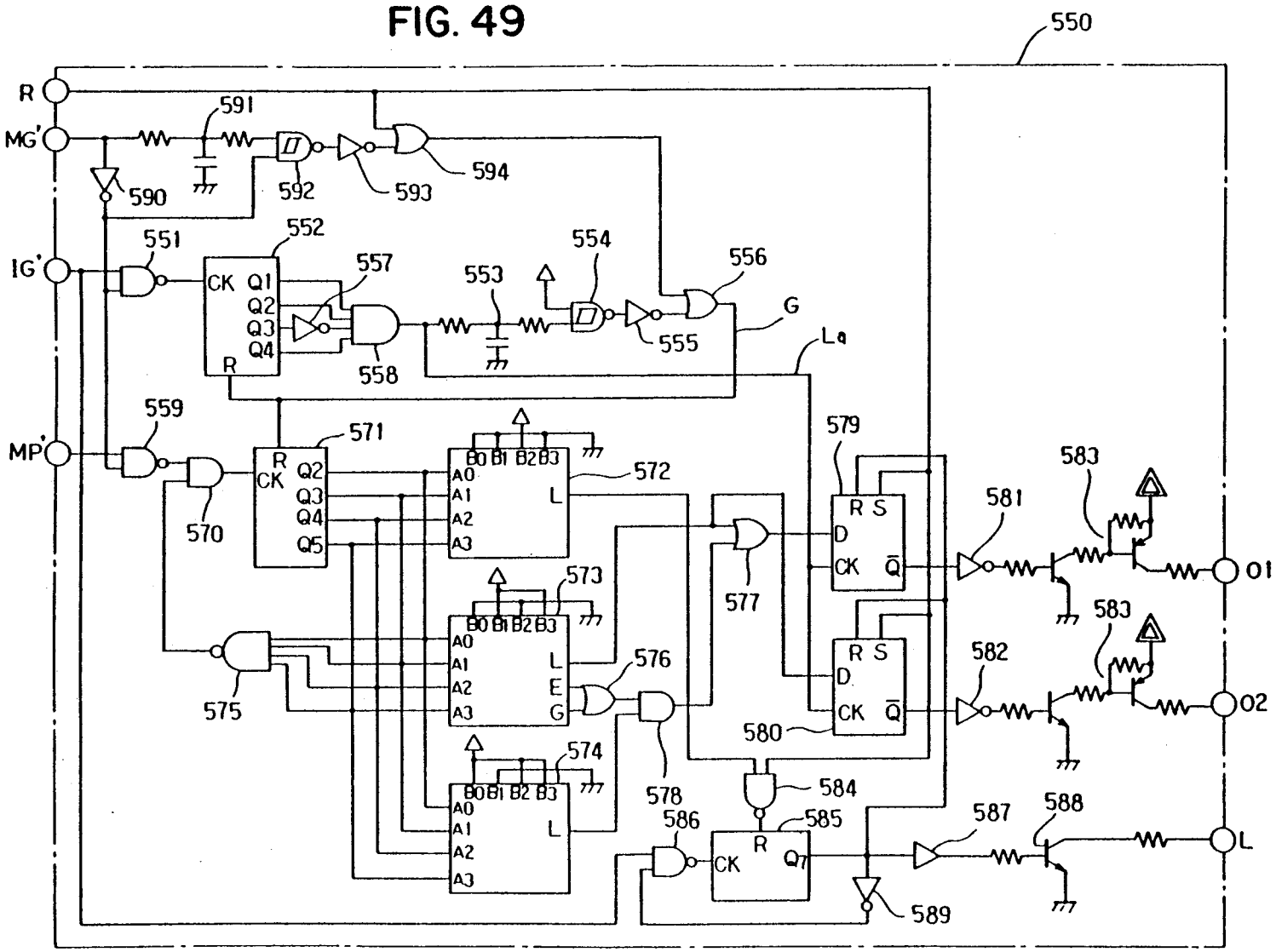

The output pulse MP from the detector 351 is introduced into the first wave shaping circuit 530, and the noise included in the signal MP is eliminated by a filter which is compared by a resister 531A and a condenser 531*b*, as shown in FIG. 44. The output signal MP is applied to an operational amplifier 534 through alternating current coupling condenser 532. The signal output from the amplifier 534 is shaped by a comparator 535 to be a rectangular wave so that an output signal MP' is alternated between 0V and 5V. Numeral 533 indicates a zener diode for limiting a maximum voltage, and an operational amplifier 536 and a divided resister 537 in the circuit 530 make an imaged ground.

The second wave shaping circuit 570 outputs a signal IG' the voltage of which is alternated between 0V and 5V. Since the igniting signal IG is generated at every sparking timing, two pulses of IG are generated while a crank shaft rotates one time. The third wave shaping circuit 580 employs a switching circuit using a transistor 511 (shown in FIG. 46). The output signal MG' of the third wave shaping circuit 580 is alternated between 0V when the electromagnetic crutch is energized and 5V when the electromagnetic crutch is not energized. The reset circuit 540 employs a NAND gate having a Shmitt trigger function shown in FIG. 47). The reset signal R becomes 5V when the electric power switch is turned off and the signal R returned to 0V after a predetermined period. A battery circuit 560 employs a diode 562 which protects the circuit even when the circuit is incorrectly connected and a voltage regulator 561 by which a constant voltage of 5V and 12V is output (shown in FIG. 48). The signal MG', IG', MP' and R are applied to the calculating circuit 550. The igniting signal IP' is input into a counter 552 through a NAND gate 551. The output signals Q11–Q4 of the counter 552 work as a latch signal LA by cooperating with an inverter 557 and an AND gate 558, and the latch signal LA is input into a OR gate 556 through a resister, a condenser 553, a NAND gate 554 having a Shmitt trigger function and an inverter 555. The OR gate 556 outputs a gate signal G which is applied to a reset terminal of the counter 552. Both the 25 latch signal LA and the gate signal G are generated every 11 pulses of the igniting signal IG'.

The signal MP' is applied to a CK terminal of a counter 571 through a NAND gate 559 and an AND gate 570 so that the counter 571 counts number of the pulse signal MP' at the timing when the gate signal G is applied. The output signals Q2-Q5 of the counter 571 are applied to a magnitude comparators 572, 573 and 574, respectively, for comparing the value of the counter and the setting value of the each of the magnitude comparator. The set values B0-B3 of the comparator 572 is 4, and that B0-B3 of the comparator 573 is 10, that B0-B3 of the comparator 574 is 13. The output signal of the magnitude comparator 573 and 574 are applied to a D terminal of the flip-flaps 579 and 580 through OR gates 576 and 577 and an AND gate 578 for latching the latch signal LA. The output signals of the D flip-flaps 579 and 580 make the output signals 01 and 02 cooperating with inverters 581 and 582 and transistor circuits 583. Accordingly, the capacity of the compressor is calculated by counting number of the pulse signals MP' while the period of eleven (11) pulses of the generating signal IG' are input. Such eleven (11) pulses of the igniting signal IG' correspond to six (6) rotations of the compressor. As shown from FIG. 50, the capacity of the compressor is categorized into three conditions by the counted number of pulse signals MP'.

An output signal of a L terminal of the magnitude comparator 572 is applied to a R terminal of the counter 585 via a NAND gate 584, and the igniting signal IG' is applied to a CK terminal of the counter 585 via a NAND gate 586. The magnitude comparator 572 finds the extraordinary condition when the number of the pulse MP' during eleven (11) pulses of the igniting signal IG' decrease less than seven (7) and such condition is continued more than sixty-four (64) pulses of the igniting signal IG'. The circuit 588 outputs the warning signal L when the magnitude comparator 572 finds such extraordinary condition. An output signal Q7 of the counter 585 is applied to a NAND gate 586 through an inverter 589 for preventing an overflow of the counter 585. The output signal Q7 of the counter 585 is applied to the R terminal of the D flip-flaps 579 and 580 for cancelling the signals 01 and 02 when the warning signal L is output.

Figure 51:
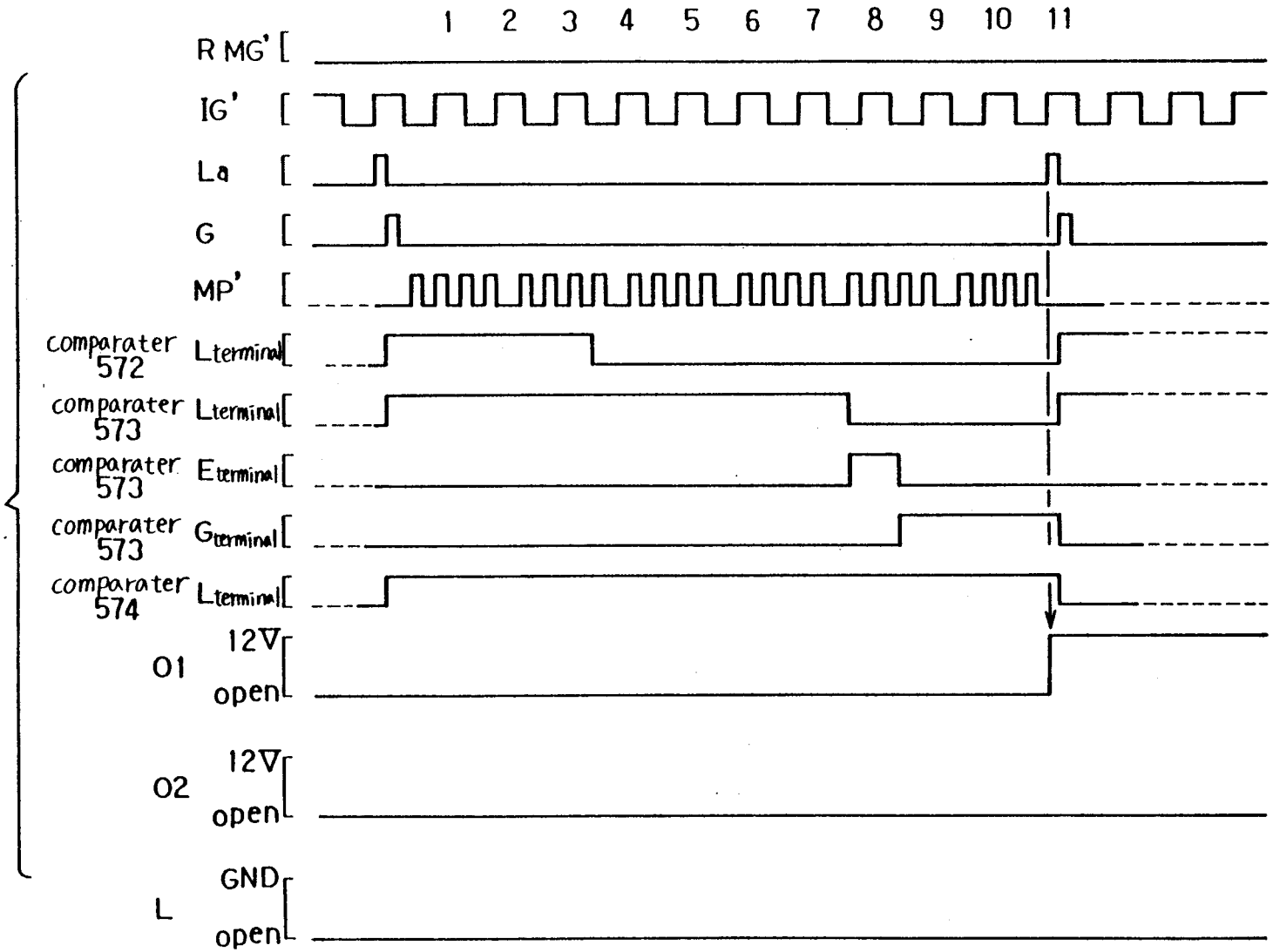
FIGS. 51 and 52 are time charts showing a sequence of a controlling circuit shown in FIG. 34.
Figure 52:
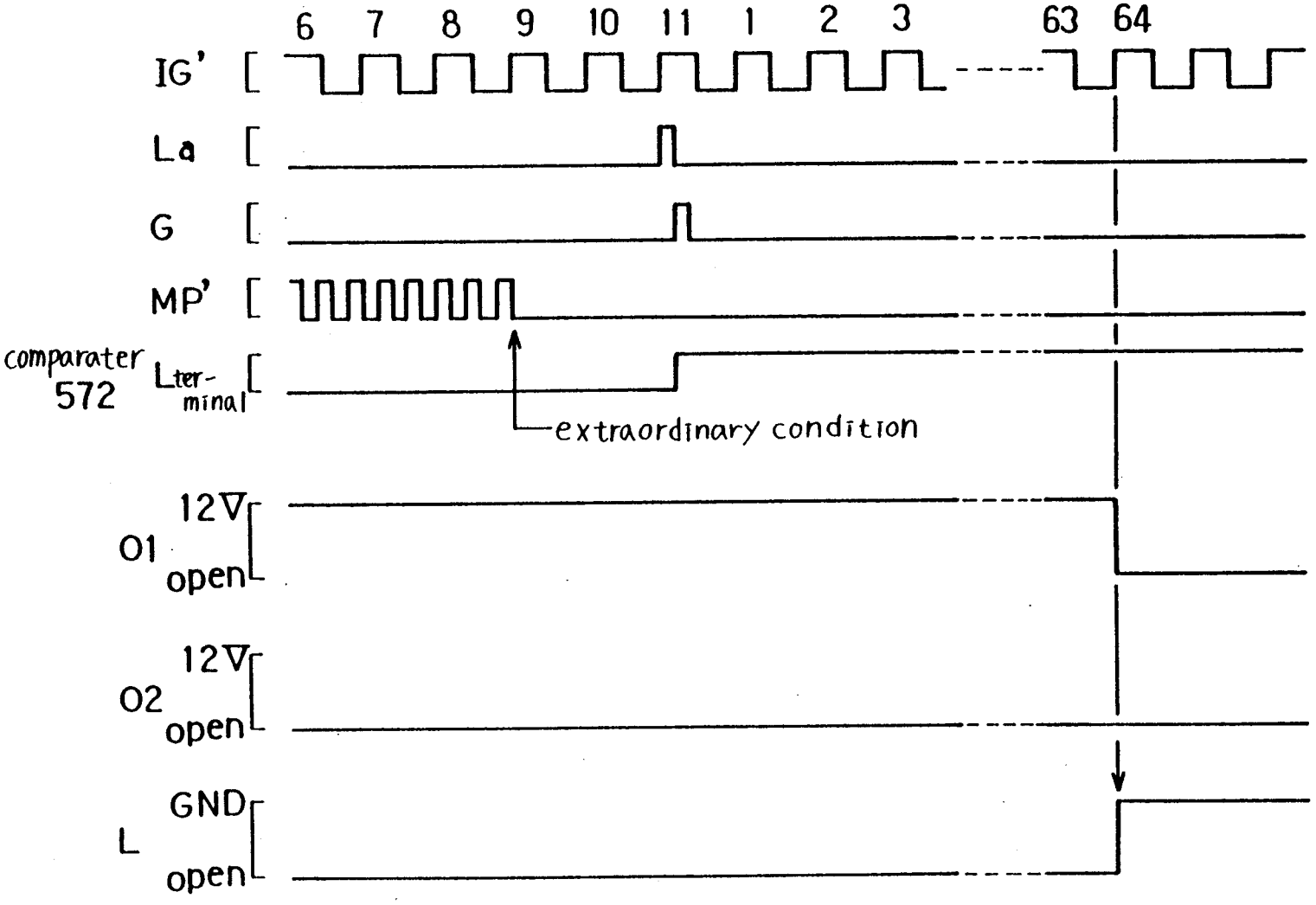

The electromagnetic crutch signal MG' is applied to NAND gates 551 and 559 via an inverter 590 for stopping the operation of the counters 552 and 571 when the electric magnetic crutch is not energized. The signal MG' is also applied to an OR gate 556 via a delay circuit 591, a NAND circuit 592 having a Shmitt trigger function, an inverter 593 and an OR gate 594 so that the counter 552 and 571 are reset when the electromagnetic crutch is energized. The reset signal R is applied to S terminals of the D flip-flaps 579 and 580, the OR gate 594 and 556 and the NAND gate 584 for resetting the counters 552, 571, and 583 when the main switch is turned on. As shown from FIG. 51 which is a time chart of the operation of the controlling circuit 600, the signal 01 becomes 12V and the signal 02 becomes open every eleven (11) pulses of the igniting signal IG' when the capacity of the compressor is medium. The signal L changes from the open condition to a ground condition at the 64th pulse of the igniting signal IG' when the circuit 600 finds the extraordinary condition as shown in FIG. 52.

Though the compressor above described embodiments employs three magnets, the number of magnets can be increased more than three in order to detect the capacity more precisely. Also a multiple magnetic pole magnet can be used as the magnet of the present embodiment. A microcomputer can be used as the controlling circuit 600 instead of the electric circuit. A signal other than the igniting signal IG can be used for calculating the number of the rotation of the shaft. The output signal of the detector 351 can be used for calculating the rotation of the compressor.

What is claimed is:

1. A variable capacity type swash plate compressor comprising:

a cylinder block having a cylinder bore therein;

a shaft rotatably provided within said cylinder block, a swash plate functionally connected with said shaft so that said swash plate rotates simultaneously with said shaft, a piston slidably provided within said cylinder bore and functionally connected with said swash plate so that said piston reciprocates within said cylinder bore, said piston defining a first working chamber and a second working chamber at respective ends thereof, a spool functionally so connected with said swash plate that a center portion of said swash plate slides along with an axis of said shaft and an inclining angle of said swash plate is varied in accordance with a moment of said spool, whereby a reciprocating movement of said piston is so controlled in such a manner that a top dead point of said piston at said first working chamber is varied while a top dead point of said piston at said second working chamber is substantially constant, a detected portion provided on an outer surface of said piston, and a detector provided on said cylinder block for detecting a change of a magnetic density relating to a movement of said detected portion and outputting a signal, said detector being provided at a position on a front side of a center portion of a reciprocating movement of said piston when a reciprocating movement of said piston is minimized.

wherein:

said detector is positioned at a side of said first working chamber of a center point of the reciprocating stroke of said detected portion, and on a side of said second working chamber of said detected portion when said detected portion moves towards said first working chamber side during a condition that a reciprocating stroke of said piston is minimized.

2. A variable capacity type swash plate compressor comprising:

a cylinder block having a cylinder bore therein;

a shaft rotatably provided within said cylinder block, a swash plate functionally connected with said shaft so that said swash plate rotates simultaneously with said shaft, a piston slidably provided within said cylinder bore and functionally connected with said swash plate so that said piston reciprocates within said cylinder bore, said piston defining a first working chamber and a second working chamber at both ends thereof.

a spool functionally so connected with said swash plate that a center portion of said swash plate slides along with an axis of said shaft and an inclining angle of said swash plate is varied in accordance with a movement of said spool, whereby a reciprocating movement of said piston is so controlled in such a manner that a top dead point of said piston at said first working chamber is varied while a top dead point of said piston at said second working chamber is substantially constant, a detected portion provided on an outer surface of said piston, and a detector provided on said cylinder block for detecting a change of a magnetic density relating to a movement of said detected portion and outputting a signal, said detector being provided at a position on a front side of a center portion of a reciprocating movement of said piston when a reciprocating movement of said piston is minimized.

wherein said detector employs a first detecting member and a second detecting member both of which are positioned in such a manner that said first detecting member is positioned on a side of said second working chamber of said detected portion when said detected portion moves toward said first working chamber side at a condition that a reciprocating stroke of said piston is minimized, and said second detecting member is positioned on a side of said second working chamber from said detected portion when said detected portion moves toward said first working chamber at a condition that a reciprocating stroke of said piston is maximized, and that said second detecting member is positioned on said first working chamber side from said first detecting member.

3. A variable capacity type swash plate compressor claimed in claim 2, wherein:

said first detecting member and said second detecting member are positioned on said cylinder block in such a manner that both of said first detecting member and said second detecting member face to an identical said detected portion.

4. A variable capacity type swash plate compressor claimed in claim 2, wherein;

said detected portion has a first detected portion member mounted on one of said pistons, and a second detected portion member provided on said piston other than said piston on which said first detected portion member is mounted, and said first detecting member and said second detecting member are so positioned that said first detecting member and said second detecting member face to said first detected portion member and said second detected member respectively.

5. A variable capacity type swash plate compressor comprising:

a cylinder block having a cylinder bore therein;

a shaft rotatably provided within said cylinder block, a swash plate functionally connected with said shaft so that said swash plate rotates simultaneously with said shaft, a piston slidably provided within said cylinder bore and functionally connected with said swash plate so that said piston reciprocates within said cylinder bore, said piston defining a first working chamber and a second working chamber at both ends thereof, a spool functionally so connected with said swash plate that a center portion of said swash plate slides along with an axis of said shaft and an inclining angle of said swash plate is varied in accordance with a movement of said spool, whereby a reciprocating movement of said piston is so controlled in such a manner that a top dead point of said piston at said first working chamber is varied while a top dead point of said piston at said second working chamber is substantially constant, a detected portion provided on an outer surface of said piston, and a detector provided on said cylinder block for detecting a change of a magnetic density relating to a movement of said detected portion and outputting a signal, said detector being provided at a position on a front side of a center portion of a reciprocating movement of said piston when a reciprocating movement of said piston is minimized, wherein said detected portion has a plurality of magnets lined on said piston in a direction identical to a direction of the reciprocating movement of said piston, said detector generates a pulse signal a number of which is related to a number of the magnets to which said detector faces, and further comprising a counting means for counting a number of the pulse generated from said detector.

6. A variable capacity type swash plate compressor claimed in claim 5, wherein;

said detected portion has three magnets, a magnetic pole of one of said three magnets is different from a magnetic pole remaining two magnets.

7. A variable capacity type swash plate compressor comprising:

a cylinder block having a center chamber and a cylinder bore therein;

a shaft rotatably provided within said cylinder block, a swash plate functionally connected with said shaft so that said swash plate rotates simultaneously with said shaft, a piston functionally connected with said swash plate so that said piston reciprocates within said cylinder bore by receiving a driving force from said swash plate, said piston defining a pair of working chambers at both ends thereof, a magnetic detected portion provided on an outer surface of said piston, first and second electromagnetic sensors provided in said cylinder block, each for detecting a transit timing of said detected portion thereover by sensing a change of magnetic density due to a reciprocating motion of said detected portion said electromagnetic sensors outputting signals in accordance with the change of the magnetic density, and a calculating means for calculating a ratio of a first period to a second period, said first period being from a time when said detected portion crosses an electromagnetic sensor to a time when said detected portion crosses an electromagnetic sensor again, said second period being one stroke period of the detected portion, said first electromagnetic sensor being positioned in said second working chamber side against said detected portion when said detected portion moves into said first working chamber sidemost at a condition wherein a reciprocating stroke of said piston is minimized, said second electromagnetic sensor being positioned in said second working chamber side against said detected portion when said detected portion moves into said first working chamber sidemost at a condition wherein a reciprocating stroke of said piston is maximized and said second detecting member is positioned in said first working chamber side against said first detecting member.

8. A variable capacity type swash plate compressor claimed in claim 7 further comprising:

a spool functionally connected with said swash plate so that a center portion of said swash plate slides along with an axis of said shaft and an inclining angle of said swash plate is varied in accordance with a movement of said spool, whereby a reciprocating movement of said piston is controlled in such a manner that a top dead point of said piston at said first working chamber is varied while a top dead point of said piston at said second working chamber is substantially constant.

9. A variable capacity type swash plate compressor claimed in claim 7, further comprising;

a calculating means for calculating an amount of reciprocating stroke of said piston by using an output signal of said detector.

10. A variable capacity type swash plate compressor claimed in claim 9, wherein;

said calculating means has a wave shaping means for shaping the output signal of said detector to rectangular wave, and an averaging means for averaging the rectangular wave shaped signal to an output voltage a level of which is continuously varied.

11. A variable capacity type swash plate compressor claimed in claim 10, wherein;

said calculating means includes a means for detecting a noise included in the output signal from said detector and a means for eliminating the noise.

12. A variable capacity type swash plate compressor comprising:

a cylinder block having a center chamber and a cylinder bore therein;

a shaft rotatably provided within said cylinder block, a swash plate functionally so connected with said shaft that said swash plate rotates simultaneously with said shaft, a piston functionally so connected with said swash plate that said piston reciprocates within said cylinder bore by receiving a driving force from said swash plate, said piston defining a pair of working chambers at both ends thereof, a first and a second magnetic detected portion both of which are mounted on said piston in such a manner that a magnetic pole of said first magnetic detected portion is different from a magnetic pole of a second magnetic detected portion, an electromagnetic sensor provided in said cylinder block for detecting a transit timing of said detected portion thereover by sensing a change of magnetic density due to the reciprocating motion of said detected portion, said electromagnetic sensor being positioned between a middle point of a reciprocating stroke of said first magnetic detected portion, wherein a reciprocating stroke of said piston is minimized and a dead point of said first magnet wherein said first magnet moves most into said first working chamber side, and said electromagnetic sensor being also positioned between a middle point of a reciprocating stroke of said second magnetic detected portion, wherein a reciprocating stroke of said piston is maximized and a dead point of said second magnetic detected portion, wherein said second magnet moves toward said first working chamber side, and said electromagnetic sensor outputting a signal in accordance with the change of the magnetic density, and calculating means for calculating a ratio of a first period to a second period, said first period being from a time when a detected portion crosses the electromagnetic sensor to a time when said detected portion crosses said electromagnetic sensor again, said second period being one stroke period of a detected portion.

13. A variable capacity type swash plate compressor claimed in claim 12 further comprising:

a spool functionally connected with said swash plate so that a center portion of said swash plate slides along with an axis of said shaft and an inclining angle of said swash plate is varied in accordance with a movement of said spool, whereby a reciprocating movement of said piston is controlled in such a manner that a top dead point of said piston at said first working chamber is varied while a top dead point of said piston at said second working chamber is substantially constant.

* * * * *